US008684043B2

(12) United States Patent
Baumeler

(10) Patent No.: US 8,684,043 B2
(45) Date of Patent: Apr. 1, 2014

(54) TEXTILE SUBSTRATE WITH WATER AND WATER VAPOR DISSIPATING PROPERTIES

(75) Inventor: Alfred Baumeler, Altendorf (CH)

(73) Assignee: Gessner Holding AG, Zurich (CH)

( * ) Notice: Subject to any disclaimer, the term of this patent is extended or adjusted under 35 U.S.C. 154(b) by 29 days.

(21) Appl. No.: 13/445,400

(22) Filed: Apr. 12, 2012

(65) Prior Publication Data

US 2013/0269823 A1 Oct. 17, 2013

(51) Int. Cl.
*D03D 15/00* (2006.01)
*D03D 23/00* (2006.01)
*D03D 25/00* (2006.01)

(52) U.S. Cl.
USPC ..... 139/416; 139/383 R; 139/420 R; 139/426 R

(58) Field of Classification Search
USPC ..... 139/383 R, 416, 418, 420 R, 426 R, 427, 139/420 A, 420 B
See application file for complete search history.

(56) References Cited

U.S. PATENT DOCUMENTS 2,087,389 A * 7/1937 Stark ..... 139/420 R
2,409,089 A * 10/1946 Whitman ..... 139/420 R
2,420,565 A * 5/1947 Rugeley et al. ..... 66/202
3,033,239 A * 5/1962 Kenin ..... 139/35
3,250,095 A * 5/1966 Bird ..... 66/178 R
3,526,084 A * 9/1970 London, Jr. et al. ..... 57/239
4,196,574 A * 4/1980 Rhash ..... 57/226
4,632,860 A * 12/1986 D'Antonio et al. ..... 442/71
6,509,286 B2 * 1/2003 Albin ..... 442/209
7,428,772 B2 * 9/2008 Rock ..... 28/159
7,507,272 B2 * 3/2009 Emig et al. ..... 55/527
7,682,994 B2 * 3/2010 Van Emden et al. ..... 442/181
2001/0024918 A1 * 9/2001 Albin ..... 442/310
2002/0064639 A1 * 5/2002 Rearick et al. ..... 428/292.1
2002/0083690 A1 * 7/2002 Emig et al. ..... 55/382
2003/0181118 A1 * 9/2003 Ko et al. ..... 442/335
2006/0137529 A1 * 6/2006 Emig et al. ..... 96/153

(Continued)

FOREIGN PATENT DOCUMENTS

EP 1127969 8/2001
FR 2776309 9/1999
JP 60-126357 7/1985

OTHER PUBLICATIONS

International Preliminary Report on Patentability dated Aug. 13, 2013, in International Application No. PCT/CH2012/000037.

(Continued)

*Primary Examiner* — Bobby Muromoto, Jr.
(74) *Attorney, Agent, or Firm* — Banner & Witcoff, Ltd.

(57) ABSTRACT

A textile substrate includes warp and weft, wherein the warp includes a plurality of warp threads and the weft includes a plurality of weft threads. At least one of the weft threads may include a first yarn and at least one of the weft threads may include a second yarn. The first yarn may be a yarn which includes fibers made of wool and regenerated cellulose and at least one third fiber in the form of a continuous fiber made of a synthetic material. The second yarn may contain regenerated cellulose fibers, wherein the proportion by mass of the regenerated cellulose fibers respectively contained in the second yarn as a proportion of the total mass of the second yarn is greater than the proportion by mass of the respective second regenerated cellulose fibers contained in the first yarn as a proportion of the total mass of the first yarn.

36 Claims, 7 Drawing Sheets

(56) References Cited

U.S. PATENT DOCUMENTS

| | | | | |
|---|---|---|---|---|
| 2006/0277950 | A1* | 12/2006 | Rock | 66/169 R |
| 2007/0044861 | A1* | 3/2007 | Stewart et al. | 139/383 R |
| 2007/0093162 | A1* | 4/2007 | Holcombe et al. | 442/208 |
| 2008/0096001 | A1* | 4/2008 | Emden et al. | 428/222 |
| 2008/0220703 | A1* | 9/2008 | Jung | 451/539 |
| 2009/0214815 | A1* | 8/2009 | Okada | 428/107 |
| 2011/0039088 | A1* | 2/2011 | Lee et al. | 428/222 |
| 2012/0058294 | A1* | 3/2012 | Todt et al. | 428/90 |
| 2012/0064313 | A1* | 3/2012 | Rock et al. | 428/212 |
| 2013/0042385 | A1* | 2/2013 | Hines et al. | 2/85 |

OTHER PUBLICATIONS

International Search Report mailed Feb. 6, 2013, in International Application No. PCT/CH2012/000037.

* cited by examiner

TEXTILE SUBSTRATE WITH WATER AND WATER VAPOR DISSIPATING PROPERTIES

TECHNICAL FIELD

One or more aspects of the invention relate to a textile substrate consisting of warp and weft, which wicks water and water vapor and comprises wool and at least regenerated cellulose fibers.

RELATED ART

Such textile substrates are characterized by an outstanding capacity to absorb and wick water and water vapor. They have for example the property that moisture (e.g. water, water vapor) reaching an outer surface of the respective textile substrate is wicked away from the surface and is transported into the interior of the textile substrate. Because of this property such textile substrates are suitable for example as a seat cover for a seat unit, particularly as a seat cover formed from such a textile substrate can absorb and transport moisture given off by a person when sitting on the seat cover, so that even after sitting for a relatively long time the person does not perceive the seat cover as moist, but generally as dry. Accordingly such seat covers ensure "air-conditioned" seating, which is associated with very comfortable seating.

These textile substrates generally have a high breathability, a comparatively low thermal resistance and a good capacity to transport and absorb moisture and can therefore generally ensure "passive" air-conditioned seating (without influencing the moisture by control engineering means): In combination with one another the aforementioned properties of these textile substrates result in seat surfaces formed from such textile substrates remaining relatively dry and pleasantly cool. Therefore such textile substrates are suitable in particular as seat covers for seat units which are generally used for long periods of sitting without interruption, e.g. for seat units in automobiles and buses, in rail vehicles and in aircraft and for office chairs, wheelchairs, etc.

In one example a textile substrate for absorbing and wicking water is known which is composed of a first thread system in the form of warp threads (referred to below as "warp") and a second thread system in the form of weft threads (referred to below as "weft") and contains fibers of wool and fibers of a regenerated cellulose in the form of viscose (CV). One of the said thread systems (i.e. the warp or the weft) comprises a mixed yarn consists of 30-70 percent by weight (referred to below as "% by weight") of wool and 30-70% by weight of viscose and the respective other one of the thread systems (i.e. the weft or the warp) comprises alternately a mixed yarn consisting of 30-70% by weight of wool and 30-70% by weight viscose and a yarn consisting of 100% by weight of viscose. In this textile substrate the viscose fibers in particular are capable of absorbing relatively large amounts of water and wicking it over relatively large distances into the respective fibers, so that the textile substrate has an absorption capacity with regard to water which is suitable in order to use the substrate for seat covers.

Furthermore textile substrates are known which transport the moisture by means of capillary systems. They preferably consist of fibers of polymeric materials. As a rule such fibers only absorb extremely little or no moisture, so that textile substrates made of such fibers absorb and transport the moisture in each case into spaces between the respective fibers, wherein the moisture forms boundary layers on adjoining surfaces of individual fibers and can be transported in these boundary layers along the respective surfaces of the fibers.

Such textile substrate are generally sorbent for moisture because of their structure, i.e. the respective geometric arrangement of the surfaces of the individual fibers determines the ability of the respective textile substrate to absorb and to transport moisture. In general moisture can only be transported relatively efficiently between different fibers if the fibers are relatively thin and are disposed in a relatively high density in bundles, so that capillary action can be effective. This results in the disadvantage that with regard to the geometric arrangement of the respective fibers in the respective textile substrate there is only a little scope for varying the arrangement of the fibers, particularly since otherwise the requirements for air-conditioned seating cannot be met. Furthermore of the transport the moisture is also restricted: Because of the capillary action the moisture is preferably distributed along the respective fiber bundle, so that the moisture is distributed substantially along a surface which is determined by the arrangement of the respective fibers. For specific requirements, for example in the case of sports clothing, this is desirable, particularly since on the boundary surfaces a high cooling performance and simultaneously rapid drying can be achieved, due to evaporation of water on the boundary surfaces and the extraction from the textile substrate of the amount of heat required for this process. However, the above-mentioned effects conflict with essential prerequisites which must be met for passively air-conditioned seating and can generally only be achieved under conditions which are not compatible with "air-conditioned" seating. On the one hand a textile substrate of the above-mentioned type actually achieves the above-mentioned cooling effect only when the person sitting thereon is already perspiring intensively. When a person who is perspiring has been in contact for a relatively long time with a surface of such a textile substrate and subsequently moves away from this surface, then the moisture collected on this surface evaporates and cools this surface relatively intensely in a relatively short time. A repeated contact with the surface of the textile substrate would be perceived the person under the above-mentioned conditions as "cold and wet". This latter is opposed to the use of such a textile substrate as a seat cover for a seating unit for long periods of sitting, particularly since people on such seat units sit for a relatively long time period with brief interruptions, so that a person would perceive a repeated contact with the respective seat cover after any such interruption as "cold and wet" and thus as unpleasant.

Furthermore textile substrates are known which contain intimate mixtures of wool by 5%-15% of polymer fibers. The disadvantages of this are the relatively slow drying of the right side of the product and low transport of heat, and an advantage is the good abrasion resistance. Furthermore, textile substrates containing fibers made of wool and polymers are known, the behavior of which with regard to moisture is determined by the aforementioned effects of fibers made of polymers and the property of wool that it absorbs water vapor. In this case a high proportion of staple fibers made of polymers has the effect that the drying ability of the substrate is improved; however, disadvantages are a limited absorption and storage of moisture and a low thermal conductivity of the textile substrate.

Textile substrates are also known which are formed as a multi-layer structure formed of a plurality of layers disposed above one another, optionally composed of different materials and connected to one another. Such textile substrates are generally relatively expensive because of their complex structure. Furthermore, because of their multi-layer structure such textile substrates generally have insufficient surface stability for use as a seat cover.

With regard to seat units there is a constant requirement on the one hand to reduce the weight of the seat unit as much as possible and moreover to improve the seating comfort by means which positively influence and regulate the seating climate. This results in the requirement to construct seat units from the fewest possible lightweight components which can guarantee the desired properties of the seat unit. In this case the seat surface plays a particular role as interface between person and seat for well-being when sitting. Seat units generally comprise a deformable sub-structure which supports the respective seat cover. Such sub-structures are predominantly produced from foamed materials which are not very thick in order to reduce weight to. The thinner such sub-structures are, the less moisture they are able to absorb. The same applies to textile substrates which are used as seat covers.

Such designs often lead to the person perspiring when sitting in the region of the contact surface with the seat cover. These negative effects are frequently compensated by energy-intensive and costly solutions for cooling the environment of the seat unit with simultaneous air drying, wherein experience suggests that as a result for a person sitting on the seat unit the seating comfort (in the sense of prolonged wellbeing) is insufficient, because a seated person generally reacts sensitively to differences between the properties of the respective seat (in the present case takes the person tends to be aware of moist seat surfaces and high seat surface temperatures) and properties the environment (in this case takes the person is aware of an artificially lowered ambient temperature and a reduced humidity) and these differences are perceived as all the more irritating the greater these differences are.

SUMMARY

In one or more embodiments of the present invention, the aforementioned disadvantages are avoided. In one or more aspects of the invention, a textile substrate is created which is of relatively simple construction and can be produced cost-effectively and with regard to wicking moisture (water and/or water vapor) it has properties which make it possible to use the textile substrate as a seat cover which allows passive air-conditioned seating with improved seating comfort during long periods of sitting.

The textile substrate according to one or more aspects of the invention (example 1) includes warp and weft and comprises wool and at least regenerated cellulose fibers, wherein the warp comprises a plurality of warp threads and the weft comprises a plurality of weft threads and wherein each warp thread crosses over a plurality of weft threads respectively at least at one intersection and each weft thread crosses over several warp threads respectively at least at one intersection, so that the warp and the weft together form a layer which has a first surface on one side and has a second surface opposite the first surface on another side. In this case it is presupposed that at least one of the weft threads consists of a first yarn and at least one of the weft threads consists of a second yarn.

According to one or more aspects of the invention the first yarn is a three-component yarn which comprises a plurality of first fibers made of wool, a plurality of second fibers made of regenerated cellulose and a plurality of third fibers in the form of continuous fibers made of a synthetic material. Furthermore the second yarn may contain a predetermined amount of regenerated cellulose fibers, wherein the percentage of the mass ("proportion by mass") of the regenerated cellulose fibers respectively contained in the second yarn as a proportion of the respective total mass of the second yarn is greater than the percentage of the mass ("proportion by mass") of the respective second regenerated cellulose fibers contained in the first yarn as a proportion of the respective total mass of the first yarn.

Furthermore the layer may comprise at least one region in which the at least one weft thread consisting of the first yarn and the at least one weft thread consisting of the second yarn extend in such a way that (i) the at least one weft thread consisting of the first yarn comprises one or more longitudinal sections, which each extend between two neighboring intersections and on the first surface of the layer, and one or more longitudinal sections which each extend between two neighboring intersections and over at least a part of their length on the second surface of the layer, and (ii) the at least one weft thread consisting of the second yarn comprises one or more longitudinal sections, which each extend between two neighboring intersections and over at least a part of their length on the first surface of the layer, and one or more longitudinal sections which each extend between two neighboring intersections and on the second surface of the layer, and (iii) in the case of the at least one weft threads consisting of the first yarn the overall length of all those longitudinal sections which extend in the at least one region of the layer on the first surface of the layer is greater than the overall length of all those longitudinal sections which extend in the at least one region of the layer on the second surface of the layer, and (iv) in the case of the at least one weft threads consisting of the second yarn the overall length of all those longitudinal sections which extend in the at least one region of the layer on the first surface of the layer is smaller than the overall length of all those longitudinal sections which extend in the at least one region of the layer on the second surface of the layer.

Because each warp thread crosses over a plurality of weft threads at least at one intersection and each weft thread crosses over a plurality of warp threads at an intersection, so that the warp and the weft together form a layer, the textile substrate according to one or more aspects of the invention does not form a multi-layer structure, i.e. it does not form a structure in which specific part-quantities of the warp threads together with specific part-quantities of the weft threads are disposed in different layers above one another within the textile substrate. Because the warp threads and weft threads together are disposed in only one layer, the textile substrate has the advantage that it can be produced by relatively simple means and with relatively low expenditure and thus cost-effectively.

The textile substrate wicks water and water vapor, wherein for wicking of water and water vapor on the one hand the material of the fibers contained in the first yarn and in the second yarn and on the other hand the spatial arrangement of the different fibers or the spatial arrangement of the first yarn and of the second yarn in the textile substrate play a significant part.

If the textile substrate is used as a seat cover and a person sitting on the textile substrate, when seated, gives off moisture (e.g. water and/or water vapor) and generally also heat to the textile substrate, then the wicking of the moisture in the textile substrate and the respective temperature of the substrate substantially determine the seating comfort. One or more aspects of the invention are therefore based on the idea that in order to optimize the seating comfort the spatial arrangement of the different fibers contained in the first yarn and in the second yarn is chosen so that it gives the person seated a perception of the reaction of the textile substrate to the moisture and heat given off to the textile substrate which is as pleasant as possible.

The reaction of the textile substrate according to one or more aspects of the invention to moisture is substantially determined by the fact that the first yarn and the second yarn on the one hand comprise different fibers (i.e. fibers made of wool and regenerated cellulose and fibers in the form of continuous fibers made of a synthetic material in the case of the first yarn, at least fibers made of regenerated cellulose in the case of the second yarn), and that the first yarn and the second yarn are each disposed differently relative to the first surface or the second surface respectively. The consequence of this on the one hand is that the first yarn and the second yarn relative to moisture exhibit a different behavior. A further consequence of this is that the textile substrate exhibits an asymmetry under the action of moisture: Because of the different arrangement of the first yarn and of the second yarn the first surface and the second surface of the textile substrate also exhibit a different behavior under the action of moisture.

Both the respective fibers made of wool and the respective fibers made of regenerated cellulose are textile fibers which can absorb large amounts of moisture and, in an environment in which the indoor climate and thus also the moisture can change, these fibers absorb so much moisture that there is a continuous moisture balance between the fibers and the environment (at least within a certain spectrum of different indoor climate conditions). In order to continuously enable a moisture balance between the respective fibers and the environment, in each case an absorption and a desorption of moisture, based upon molecular permeation, takes place simultaneously.

However, in this connection it should be borne in mind that fibers made of wool and fibers made of regenerated cellulose differ with regard to their ability to absorb water or water vapor or to transport or water vapor in the respective fibers. Fibers made of regenerated cellulose can for example absorb water (in the liquid state) substantially more quickly and can also release it substantially more quickly than fibers made of wool. Accordingly fibers made of wool require a substantially longer time for drying than fibers made of regenerated cellulose. On the other hand fibers made of wool (in contrast to fibers made of regenerated cellulose) absorb relatively large amounts water vapor.

The continuous fibers made of a synthetic material which are present in the textile substrate influence a reaction of the textile substrate to moisture in two respects. On the one hand these continuous fibers can transport moisture on their surfaces by sorption and therefore have the tendency to distribute moisture on their surfaces, preferably in spaces between neighboring continuous fibers by means of capillary action, and to dry rapidly. On the other hand these continuous fibers made of a synthetic material are used in order to influence the spatial arrangement of fibers made of wool or regenerated cellulose in the textile substrate so that the respective arrangement of these continuous fibers also indirect influences the reaction of the respective fibers made of wool and made of regenerated cellulose.

Because of the above-mentioned features (i)-(iv) the textile substrate according to one or more aspects of the invention may include one or more of the following properties with regard to reaction to moisture:

thus since both the respective weft thread made of the first yarn and also the respective weft thread made of the second yarn according to the features (i) and (ii) extend at least in sections on the first surface and at least in sections on the second surface, both the respective weft thread made of the first yarn and also the respective weft thread made of the second yarn enable an exchange of moisture from the first surface to the second surface and vice versa.

Both the first yarn and also the second yarn each comprise one or more fibers made of regenerated cellulose. Because the proportion by mass of the respective regenerated cellulose fibers contained in the second yarn as a proportion of the respective total mass is greater than the proportion by mass of the respective second fibers made of regenerated cellulose contained in the first yarn as a proportion of the respective total mass of the first yarn and the respective fibers made of cellulose regenerate can absorb water (in the liquid state) substantially more quickly and in larger amounts than the respective fibers made of wool (present at least in the first yarn), considerably more water is generally absorbed by the second yarn than by the first yarn from a quantity of water which may be brought into contact (in the liquid state) with the textile substrate. This difference with regard to the amount of water absorbed per unit of time is increased the greater the difference is between the proportion by mass of the regenerated cellulose fibers respectively contained in the second yarn as a proportion of the respective total mass of the second yarn and the proportion by mass of the respective second regenerated cellulose fibers contained in the first yarn as a proportion of the respective total mass of the first yarn. Accordingly liquid water is predominantly absorbed by the respective weft threads consisting of the second yarn.

Accordingly if water in the liquid state is brought into contact with the first surface of the textile substrate, then this water is preferably absorbed via the respective longitudinal sections of the weft threads consisting of the second yarn and extending on the first surface and thus transported into the interior of the textile substrate. Since in the case of the respective weft thread consisting of the second yarn the overall length of all those longitudinal sections which extend in the at least one region of the layer on the first surface of the layer is less than the overall length of all those longitudinal sections which extend in the at least one region of the layer on the second surface of the layer, the majority of the water penetrating from the first surface into the interior of the textile substrate collects in the longitudinal sections of the respective weft threads consisting of the second yarn extending on the second surface of the textile substrate. Accordingly this water is concentrated in the vicinity of the second surface of the textile substrate.

Those longitudinal sections of the at least one weft thread consisting of the first yarn which according to feature (iii) extend in the at least one region of the layer on the first surface of the layer, and those longitudinal sections of the at least one weft thread consisting of the second yarn which according to feature (iv) extend in the at least one region of the layer on the second surface of the layer, cross over the respective warp threads on opposing sides of these warp threads (i.e. on the side of the respective warp thread facing the first surface or on the side of the respective warp thread facing the second surface). The warp threads have the effect that those longitudinal sections of the at least one weft thread consisting of the first yarn which according to feature (iii) extend in the at least one region of the layer on the first surface of the layer, and those longitudinal sections of the at least one weft thread consisting of the second yarn which according to feature (iv) extend in the at least one region of the layer on the second surface of the layer, are spatially separated by the warp threads in the direction of a vertical with respect to the first surface of the layer (or in the direction of a vertical with respect to the second surface of the layer). This spatial separation increases as the thickness of the respective warp threads is greater. This spatial separation in the direction of the vertical has the effect that the water, which (as set out above) is preferably concentrated in the vicinity of the second surface, is concentrated at a relatively large distance from the first surface. This results in a spatial distribution of the concentration of moisture in the interior of the textile substrate between the first surface and the second surface in such a way that the concentration of the moisture—starting from the first surface—increases progressively in the direction of the second surface. The content thereof is explained in greater detail below.

Due to the spatial arrangement of the first yarn and of the second yarn (according to the features (iii) and (iv)) with regard to absorption of water (in the liquid state) on the first surface the textile substrate according to the invention behaves in a weakly hydrophobic manner, while the textile substrate on the second surface for water (in the liquid state) is hydrophilic and strongly absorbent.

The respective fibers made of wool ensure that the textile substrate has a high permeability for moisture in vapor form (water vapor) over the entire cross-section of the textile substrate. Accordingly the permeability for moisture in vapor form (water vapor) is particularly high in the regions of the textile substrate in which the respective weft threads made of the first yarn extend. If water vapor is introduced from the first surface into the textile substrate, then this has the effect that the water vapor can penetrate into the interior of the textile substrate or can penetrate the textile substrate and optionally condenses. Such condensation of the water vapor generally takes place in the vicinity of the second surface of the textile substrate. Accordingly the heat of condensation released during condensation is produced at a relatively large distance from the first surface. This has the effect that heat of condensation in the textile substrate is produced in a region of the textile substrate which is remote from the first surface. In this way is a temperature increase of the first surface due to heat of condensation advantageously largely avoided. In this case the water produced by the condensation of the water vapor can preferably be absorbed by the respective weft threads consisting of the second yarn, so that this water also is concentrated principally in the vicinity of the second surface (because of feature (iv)).

Because the first yarn contains both regenerated cellulose fibers and continuous fibers made of a synthetic material, absorption of (liquid) water in the first yarn leads to an inhomogeneous moisture distribution, particularly since the regenerated cellulose fibers can absorb water quickly and in large amounts, whilst the continuous fibers made of a synthetic material dry quickly. In the production of the first yarn the respective continuous fibers made of a synthetic material (third fibers) are guided so that the respective continuous fibers are disposed primarily on the outer edge of the cross-section of the first yarn, whilst the fibers made of regenerated cellulose are disposed in the center or in the vicinity of the center of the cross-section. Such a distribution of the fibers has the effect that the first yarn after absorption of liquid water in a layer adjoining the surface of the yarn can dry quickly because of the respective continuous fibers made of a synthetic material. Consequently after a short time the water absorbed by the first yarn is spatially distributed in such a way that the concentration of the water—based on a cross-section of the first yarn—is at a maximum in a central region of the cross-section, whilst the concentration of the water on the edge of the cross-section is low, so that the current distribution of the moisture contained in the first yarn has a gradient which is directed at the center of the cross-section of the first yarn. This leads to several advantages. On the one hand the first surface of the textile substrate can dry within an extremely short time after absorption of water, so that the first surface of the textile substrate feels dry. On the other hand the water which is contained in the respective fibers made of regenerated cellulose can be released in a metered way to the surface of the first yarn and evaporate there. The latter leads to a metered cooling of the first surface of the textile substrate, particularly since because of the feature (iii) the first yarn extends over a greater length on the first surface than on the second surface, so that the above-mentioned evaporation of water and cooling accompanying the evaporation takes place principally on the first surface of the textile substrate.

Since the respective second yarn also extends at least over a certain part its length on the first surface (features (ii) and (iv)), moisture can pass via the second yarn from the second surface to the first surface and can be desorbed and evaporated by the respective longitudinal sections of the second yarn extending on the first surface. This process also enables metered cooling of the first surface of the textile substrate.

The above-mentioned properties are in particular advantageous with regard to use of the textile substrate as a seat cover of a seat unit and in this case in particular create the prerequisite for passive air-conditioned seating with an improved seating comfort during long periods of sitting.

If the textile substrate is used as a seat cover then it is in particular advantageous if the first surface of the textile substrate serves as seat surface (i.e. as the right side of the seat cover). If a person sitting for a long period of time on the textile substrate with body contact with the first surface of the textile substrate continuously gives of moisture (water in the liquid state and/or water vapor) onto the first surface in the at least one region of the textile substrate, then several advantageous effects are apparent.

On the one hand, because of the spatial arrangement of the weft threads consisting of the first yarn or the second yarn and the arrangement of the respective fibers in the first yarn or in the second yarn, the moisture (i.e. the water penetrating via the first surface into the textile substrate and the water produced by condensation of the water vapor in the textile substrate) is distributed in the at least one region of the textile substrate spatially in different layers which extend substantially parallel to the respective surfaces of the textile substrate and are disposed following one another in a direction perpendicular to the textile substrate, wherein the respective concentration of the moisture varies in each case as a function of the distance from the first surface. In this case the concentration of the moisture increases progressively in the textile substrate as a function of the distance from the first surface generally in the direction of the second surface, so that the concentration of the moisture in the textile substrate as a function of the distance from the first surface exhibits a non-linear gradient, in particular progressively increasing in the direction of the second surface (referred to below as "progressive moisture gradient"). In this case the concentration of the moisture has a maximum in the vicinity of the second surface, i.e. at a distance from the first surface. On the other hand the concentration of the moisture in a layer adjoining the first surface within a certain distance from the first surface is low in such a way that the seated person perceives the first surface as dry. In this case it is a particular advantage of the textile substrate according to the invention that this "dry" layer can exist on the first surface so long as the saturation limit of the textile substrate with respect to moisture is not yet reached, that is to say optionally for any length of time so long as it is ensured that the saturation limit of the textile substrate is not reached.

The progression of the concentration of the moisture as a function of the distance from the first surface also has advantages with regard to the drying of the textile substrate and the cooling of the substrate as a result of evaporation of water. On the one hand relatively little water evaporates on the first surface, so that the first surface is cooled in a metered manner by evaporation. Furthermore the fact that fibers made of wool require a substantially longer time for drying than fibers made of regenerated cellulose loses importance.

Because the water vapor penetrating into the textile substrate in the vicinity of the second surface can condense and thus the heat of condensation released during the condensation is produced at a distance from the first surface and on the other hand the first surface is constantly cooled in a metered manner by evaporation of water, the temperature of the textile substrate on the first surface can be stabilized at a value close to the body temperature of the seated person. The latter also applies when the seated person interrupts the sitting after a relatively long period of sitting. During this interruption the first surface will cool only very slowly, since the cooling of the first surface takes place in a metered manner by evaporation of water. This has the advantage that the seated person can interrupt the sitting after a relatively long period of sitting and can continue sitting after the interruption without making cooling of the first surface following the interruption perceptible in an unpleasant manner for this person.

The textile substrate according to a further aspect of the invention (example 2) may include warp and weft and comprises wool and at least regenerated cellulose fibers, wherein the warp comprises a plurality of warp threads and the weft comprises a plurality of weft threads and wherein each warp thread crosses over a plurality of weft threads respectively at least at one intersection and each weft thread crosses over several warp threads respectively at least at one intersection, so that the warp and the weft together form a layer which has a first surface on one side and has a second surface opposite the first surface on another side. In this case it is presupposed that at least one of the warp threads consists of a first yarn and at least one of the warp threads consists of a second yarn.

According to this aspect of the invention the textile substrate is formed in such a way that the first yarn is a three-component yarn which comprises a plurality of first fibers made of wool, a plurality of second fibers made of regenerated cellulose and a plurality of third fibers in the form of continuous fibers made of a synthetic material. Furthermore the second yarn contains a predetermined amount of regenerated cellulose fibers, wherein the percentage of the mass ("proportion by mass") of the regenerated cellulose fibers respectively contained in the second yarn as a proportion of the respective total mass of the second yarn is greater than the percentage of the mass ("proportion by mass") of the respective second regenerated cellulose fibers contained in the first yarn as a proportion of the respective total mass of the first yarn.

Furthermore the layer comprises at least one region in which the at least one warp thread consisting of the first yarn and the at least one warp thread consisting of the second yarn extend in such a way that (a) the at least one warp thread consisting of the first yarn comprises one or more longitudinal sections, which each extend between two neighboring intersections and on the first surface of the layer, and one or more longitudinal sections which each extend between two neighboring intersections and over at least a part of their length on the second surface of the layer, and (b) the at least one warp thread consisting of the second yarn comprises one or more longitudinal sections, which each extend between two neighboring intersections and on the first surface of the layer, and one or more longitudinal sections which each extend between two neighboring intersections and over at least a part of their length on the second surface of the layer, and (c) in the case of the at least one warp thread consisting of the first yarn the overall length of all those longitudinal sections which extend in the at least one region of the layer on the first surface of the layer is greater than the overall length of all those longitudinal sections which extend in the at least one region of the layer on the second surface of the layer, and (d) in the case of the at least one warp thread consisting of the second yarn the overall length of all those longitudinal sections which extend in the at least one region of the layer on the first surface of the layer is smaller than the overall length of all those longitudinal sections which extend in the at least one region of the layer on the second surface of the layer.

The textile substrate according to the second example differs from the textile substrate according to the first example primarily in that the arrangement or the function of the respective warp threads in the textile substrate according to the second example correspond to the arrangement or the function of the respective weft threads in the textile substrate according to the first example and the arrangement or the function of the respective weft threads in the textile substrate according to the second example correspond to the arrangement or the function of the respective warp threads in the textile substrate according to the first example. Consequently the properties and advantages which are mentioned above with regard to the weft threads or the warp threads of the textile substrate according to the first example correspond analogously to the properties and advantages which may be assigned to the warp threads or the weft threads of the textile substrate according to the second example.

Accordingly in the case of the textile substrate according to variant 2 the at least one warp thread consisting of the first yarn and the at least one warp thread consisting of the second yarn on the basis of the features (a)-(d) with regard to transport of moisture (water, water vapor) ensure the same effects which in the case of the textile substrate according to the first example are ensured by the at least one weft thread consisting of the first yarn and the at least one weft thread consisting of the second yarn on the basis of the features (i)-(iv).

Correspondingly in the case of the textile substrate according to the second example the respective weft threads have the same function as the respective warp threads in the event of the textile substrate according to the first example. In particular in the case of the textile substrate according to the second example the respective weft threads have the effect that those longitudinal sections of the at least one warp thread consisting of the first yarn which according to feature (c) extend in the at least one region of the layer on the first surface of the layer, and those longitudinal sections of the at least one weft thread consisting of the second yarn which according to feature (d)

extend in the at least one region of the layer on the second surface of the layer, are spatially separated by the weft threads in the direction of a vertical with respect to the first surface of the layer (or in the direction of a vertical with respect to the second surface of the layer). This spatial separation increases as the thickness of the respective weft threads is greater. This spatial separation in the direction of the vertical has the effect that the moisture is preferably concentrated in the vicinity of the second surface in particular at a relatively large distance from the first surface. This results in a spatial distribution of the concentration of moisture in the interior of the textile substrate between the first surface and the second surface in such a way that the concentration of the moisture—starting from the first surface—increases progressively in the direction of the second surface.

An embodiment of the textile substrate according to the first example is formed in such a way that the weft thread consisting of the first yarn is a single yarn or a ply formed from one or more single yarns and/or the weft thread consisting of the second yarn is a single yarn or a ply formed from one or more single yarns. Correspondingly an embodiment of the textile substrate according to the second example is formed in such a way that the warp thread consisting of the first yarn is a single yarn or a ply formed from one or more single yarns and/or the warp thread consisting of the second yarn is a single yarn or a ply formed from one or more single yarns. Accordingly the at least one weft thread consisting of the first yarn (in the case of the aforementioned embodiments of the textile substrate according to the first example) or the at least one warp thread consisting of the first yarn (in the case of the aforementioned embodiments of the textile substrate according to the second example) and the at least one weft thread consisting of the second yarn (in the case of the aforementioned embodiments of the textile substrate according to the first example) or the at least one warp thread consisting of the second yarn (in the case of the aforementioned embodiments of the textile substrate according to the second example) do not have to be a single yarn. The at least one weft thread or warp thread consisting of the first yarn can also for example be one ply which contains a plurality of single yarns twisted together, wherein the first yarn forms the respective single yarn; correspondingly the at least one weft thread or warp thread consisting of the second yarn can be one ply which contains a plurality of single yarns twisted together, wherein the second yarn forms the respective single yarn. In this way a high mechanical strength of the respective yarns and of the respective textile substrate, in particular a high tensile strength of the respective yarns and of the textile substrate, is ensured.

In the case of a further embodiment of the textile substrate according to the first example, one or more warp threads can consist of the first yarn. This embodiment has the advantage that the at least one weft thread consisting of the first yarn is crossed over by one or more warp threads consisting of the same (first) yarn. In this way it is advantageously ensured that moisture (in particular water vapor)—according to the aforementioned properties of the first yarn—can be transported efficiently within the textile substrate in two spatial dimensions parallel to the first surface (or the second surface). Since the warp threads consisting of the first yarn cross over both the respective weft threads consisting of the first yarn and also the respective weft threads consisting of the second yarn, the warp threads consisting of the first yarn ensure an efficient transport of moisture from the first surface of the textile substrate to the respective weft threads consisting of the second yarn. In this way, moisture penetrating into the textile substrate via the first surface (i.e. the water penetrating via the first surface into the textile substrate and the water produced by condensation of the water vapor in the textile substrate) in the at least one region of the textile substrate because of the spatial arrangement of the weft threads and warp threads consisting of the first yarn or of the weft threads consisting of the second yarn and the arrangement of the respective fibers in the first yarn or in the second yarn is distributed spatially in such a way that the respective concentration of the moisture progressively increases particularly markedly in the vicinity of the second surface in each case as a function of the distance from the first surface.

A modification of the above-mentioned embodiment of the textile substrate according to the first example may be configured in such a way that one or more weft threads consist of the second yarn and the respective weft threads cross over the respective warp threads in such a way that a warp thread consisting of the first yarn forms one or more weave points in each case with weft threads consisting of the second yarn or (in addition or alternatively) a weft thread consisting of the second yarn forms one or more weave points in each case with warp threads consisting of the first yarn.

In this context one warp thread forms a "weave point" with certain weft threads when the warp thread on the one hand crosses over three weft threads disposed adjacent to one another in such a way that the warp thread crosses over the middle one of the above-mentioned three weft threads on one side of the textile substrate and crosses over the other two of the above-mentioned three weft threads on the other side of the textile substrate. In this case "weave point" designate in each case a location (intersection) at which the warp thread crosses over the middle one of the three weft threads.

Correspondingly one weft thread forms a "weave point" with certain warp threads when the weft thread on the one hand crosses over three warp threads disposed adjacent to one another in such a way that the weft thread crosses over the middle one of the above-mentioned three warp threads on one side of the textile substrate and crosses over the other two of the above-mentioned three warp threads on the other side of the textile substrate. In this case "weave point" designates in each case a location (intersection) at which the weft thread crosses over the middle one of the three warp threads.

Because one warp thread consisting of the first yarn forms one or more weave points in each case with weft thread consisting of the second yarn, the warp thread consisting of the first yarn is in contact with the weft thread consisting of the second yarn at the respective weave point on a particularly large surface. This has the advantage, that moisture from the respective first yarn can be given off particularly efficiently at one of the respective weave points to the respective second yarn and vice versa. In this way moisture can be efficiently transferred between a first yarn and the respective second yarn transferred are in particular at the respective weave point. A corresponding advantage is achieved if a weft thread consisting of the second yarn forms one or more weave points in each case with warp threads consisting of the first yarn.

In the case of a further embodiment of the textile substrate according to the second example (analogously to the above-mentioned embodiment of the textile substrate according to the first example) one or more weft threads can consist of the first yarn. In this way the same advantages are achieved which are present in the case of the textile substrate according to the first example if one or more warp threads consist of the first yarn.

Correspondingly a modification of the above-mentioned embodiment of the textile substrate according to the second example may be configured in such a way that one or more warp threads consist of the second yarn and the respective warp threads cross over the respective weft threads in such a way that a weft thread consisting of the first yarn forms one or more weave points in each case with warp threads consisting of the second yarn or (in addition or alternatively) a warp thread consisting of the second yarn forms one or more weave points in each case with weft threads consisting of the first yarn.

An embodiment of the textile substrate is characterized in that the first yarn has a central longitudinal axis and a core zone surrounding the central longitudinal axis and extending along the central longitudinal axis and an outer zone surrounding the core zone and extending along the central longitudinal axis, and the respective first fibers, the respective second fibers and the respective third fibers are spatially distributed in the first yarn in such a way that

- a concentration of the second fibers (made of regenerated cellulose) in the core zone is greater than in the outer zone and
- a concentration of the first fibers (made of wool) in the outer zone is greater than in the core zone and
- a concentration of the third fibers (in each case in the form of a continuous fiber made of a synthetic material) in the outer zone is greater than in the core zone.

In this way moisture (water and/or water vapor) is absorbed by the first yarn in such a way that the outer zone of the respective (warp or weft) threads consisting of the first yarn dries quickly because of the respective third fibers and remains dry and can ensure transport of water vapor through the outer zone because of the fibers made of wool, whilst on the other hand water penetrating into the textile substrate or condensed in the textile substrate is absorbed by the second fibers made of regenerated cellulose in the core zone. In this case moisture is distributed in the first yarn, which enables a rapid and nevertheless metered evaporation of water. The latter has the advantage that the surfaces of the textile substrate, in particular the first surface of the textile substrate, dry in a particularly short time and the respective surfaces of the textile substrate have a pleasantly cool effect.

A further embodiment of the textile substrate is characterized in that the second fiber (made of regenerated cellulose) in the first yarn is formed as a staple fiber. Since staple fibers are generally relatively short, the respective staple fibers in the first yarn are frequently disposed in such a way that one of their ends extends to the surface of the first yarn. In this way may the respective second fiber can absorb moisture more quickly (via an end of the fiber extending to the surface of the first yarn).

The respective third fiber of the first yarn may for example comprise a polymer or a mixture of different polymers. For example the respective third fiber may comprise one or more of the polymers polyamide, polyester or polyolefin.

In the case of a further embodiment of the textile substrate the first yarn comprises the respective first fibers (made of wool) in a proportion of 25-55% by weight, the respective second fibers (made of regenerated cellulose) in a proportion of 25-55% by weight and the respective third fibers (in the form of a continuous fiber made of a synthetic material) in a proportion of 5-40% by weight. In this case the regenerated cellulose fibers enable a suitable metered evaporation of water. This reduces the danger that moisture penetrating from the first surface into the textile substrate is absorbed by the respective second yarn in a mass such that the moisture builds up in the textile substrate from the second surface to the first surface. This prevents an excessive buildup of moisture from occurring on the second surface of the textile substrate and ensures that the first surface of the textile substrate remains dry and the textile substrate is not saturated with moisture.

In a further embodiment of the textile substrate the proportion by weight of the respective first fibers and the respective second fibers relative to the total weight of the first yarn is greater than the proportion by weight of the respective third fibers relative to the total weight of the first yarn. In this case it is advantageous, that the respective first yarn can have a small diameter, in spite of relatively coarse first and second fibers.

In the case of a further embodiment of the textile substrate the second yarn comprises 50-100% by weight of regenerated cellulose fibers. In this way a particularly large proportion of the moisture which is optionally absorbed by the textile substrate can be absorbed by the second yarn. This has in particular the advantage that moisture which is brought into contact with the first surface of the textile substrate can be transported particularly efficiently via the second yarn to the second surface. Moreover the moisture in the textile substrate is distributed in such a way that a particularly substantial moisture gradient is produced which is directed from the first surface to the second surface.

With regard to the fibers made of regenerated cellulose which are contained in the first yarn or in the second yarn there are a number of possible variants. Each individual one of the respective second fibers of the first yarn and/or each individual one of the respective regenerated cellulose fibers of the second yarn preferably consists of one the materials viscose (CV), modal (CMD) or lyocell (CLY) or mixtures of these materials. The first and the second yarn can also in each case contain several different regenerated cellulose fibers which differ in that they are composed of different ones of the above-mentioned materials or of different mixtures of the above-mentioned materials.

The textile substrate according to the invention has the further advantage that it can be produced in a simple manner, e.g. as fabric.

In the case of a further embodiment of the textile substrate the respective first fiber and/or the respective second fiber and/or the respective third fiber and/or the respective regenerated cellulose of the second yarn and/or the first yarn as a whole and/or the second yarn as a whole and/or the textile substrate as a whole is impregnated with a flame-retardant agent. Because of this impregnation the textile substrate is suitable for use in many areas in which high safety standards with regard to fire protection must be met, e.g. for applications in automobiles, airplanes, railway trains, public buildings, etc.

With regard to use of the textile substrate as a seat cover, the resistance to water vapor permeability and/or the thermal resistance of the textile substrate can be optimized in order that a person seated on the textile substrate, even after a long period of sitting, finds it as pleasant as ("air-conditioned") with regard to the moisture and the temperature which the person perceives in contact with the textile substrate.

For this purpose the respective textile substrate may preferably be configured in such a way that with regard penetration of water vapor through the textile substrate it has a resistance to water vapor permeability $R_{et}$ with a $R_{et}$ value less than 9 $m^2Pa/W$ (measured on the basis of a skin model for human skin with an internationally standardized testing process according to DIN EN 31092 at a temperature of 35° C. and a relative humidity of 40%). Furthermore the respective textile substrate may preferably be configured in such a way that it has a thermal resistance $R_{ct}$ which is less than 24 $10^{-3}$ $m^2K/W$ (measured on the basis of a skin model for human skin with an internationally standardized testing process according to DIN EN 31092 at a temperature of 20° C. and a relative humidity of 65%). Both the resistance to water vapor permeability $R_{et}$ and also the thermal resistance $R_{ct}$ of the respective textile substrate depend upon different parameters, inter alia upon the density of the respective warp threads and weft threads in the textile substrate and the density and the type fibers contained in the respective warp threads and weft threads, and can accordingly be changed by varying these parameters.

If the resistance to water vapor permeability $R_{ct}$ of the textile substrate is less than 9 $m^2$ Pa/W, when a person is seated on such a textile substrate it can be ensured that the textile substrate is sufficiently permeable ("breathable") for the water vapor given off by the person while sitting on the textile substrate, so that the water vapor given off to the textile substrate changes the temperature of the textile substrate and the respective moisture contained in the textile substrate, even after a long period of sitting, in a way which is acceptable for the respective person.

If the thermal resistance $R_{ct}$ of the textile substrate is less than 24 $10^{-3}$ $m^2K/W$, when a person is seated on such a textile substrate it can be ensured that the textile substrate can remove sufficient heat in order that the textile substrate is cooled sufficiently while the person is sitting thereon and the temperature of the textile substrate does not rise to an extent which is unacceptable for the respective person, even after a long period of sitting. Thus the seated person is prevented from detecting a buildup of heat on the textile substrate or being caused to perspire in those areas of the body in contact with the textile substrate and thus releasing an excessive amount of sweat into the textile substrate.

If the textile substrate is treated with dyes in order to color the textile substrate differently from the natural colors of the fibers contained in the textile substrate, then it is helpful to color the textile substrate with the respective dyes in such a way that the textile substrate (compared with a corresponding undyed textile substrate) does not absorb infrared radiation excessively, because otherwise if exposed to infrared radiation the textile substrate would warm up in such a way that air-conditioned seating on the textile substrate can no longer be ensured.

In order to achieve the above-mentioned aim, the textile substrate according to the invention can preferably be colored in such a way that it has a reflectivity for infrared radiation in the wavelength range from 800 nm to 2000 nm on average of at least 50%. The magnitude of the reflectivity of the textile substrate may in this case be influenced by conventional means, for example by an appropriate choice of dyes, by the respective amount of dyes for coloring or by a choice of the fibers contained in the respective yarns in such a way that the above-mentioned condition is met. The above-mentioned textile substrate has the advantage that the reflectivity of the textile substrate—compared with the reflectivity of the corresponding undyed textile substrate—is relatively less reduced in the wavelength range from 800 nm to 2000 nm. Thus this textile substrate reflects a relatively large part of the infrared radiation in the wavelength range from 800 nm to 2000 nm, so that the textile substrate is only warmed up to a relatively small extent under the action of such infrared radiation and the temperature of the textile substrate only rises slightly. Consequently the intensity of any thermal radiation emitted by the textile substrate changes relatively little if infrared radiation in the wavelength range from 800 nm to 2000 nm acts on the textile substrate, so that under the said circumstances the textile substrate makes little contribution to warming up of its surroundings. Therefore the textile substrate is outstandingly suitable for a use in spaces which are flooded by sunlight and can optionally be heated by thermal radiation, e.g. for use as seat covers for seats in automobiles or other means of transport or in living areas.

The textile substrate according to the invention is suitable for example as a covering material for covering a seat and/or a seat back and/or a side part and/or an armrest of a seat unit, wherein the first surface in each case forms the outwardly directed side (right side of the product) of the covering material.

Accordingly one or more aspects of the invention also relate to a seat unit, with a seat and/or a seat back and/or a side part and/or an armrest, wherein the seat comprises a textile substrate according to the aspects of the invention and the first surface of the textile substrate forms an outer surface of the seat and/or the seat back comprises a textile substrate according to the aspects of the invention and the first surface of the textile substrate forms an outer surface of the seat back and/or the side part comprises a textile substrate according to the aspects of the invention and the first surface of the textile substrate forms an outer surface of the side part and/or the armrest comprises a textile substrate according to the aspects of the invention and the first surface of the textile substrate forms an outer surface of the armrest.

BRIEF DESCRIPTION OF THE DRAWINGS

Further details and in particular examples of embodiment of the invention are explained below with reference to the appended drawings, in which.

DETAILED DESCRIPTION

In the following detailed description of the drawings components which are the same or have the same effect have been provided with the same references for reasons of clarity.

Figure 1:
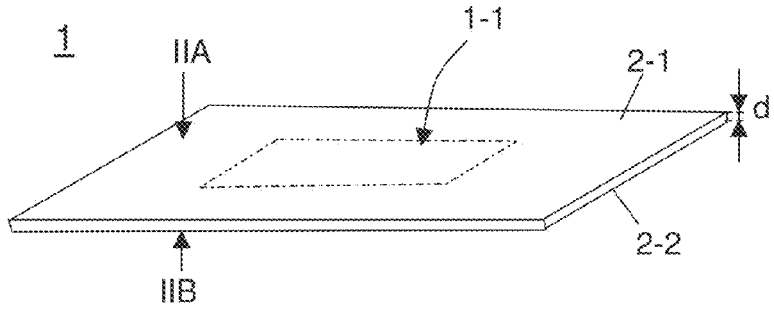
FIG. 1 shows a perspective view of a textile substrate according to one or more aspects of the invention in the form of a fabric.

FIG. 1 shows a perspective view of a textile substrate 1 according to one or more aspects of the invention in the form of a fabric which in the present example extends parallel to one plane. In this case the textile substrate 1 forms a flat layer with the thickness d and has a first surface 2-1 and a second surface 2-2 opposite the first surface 2-1. In FIG. 1 an arrow IIA points perpendicular to the first surface 2-1, and an arrow IIB points perpendicular to the second surface 2-2.

Figure 2A:
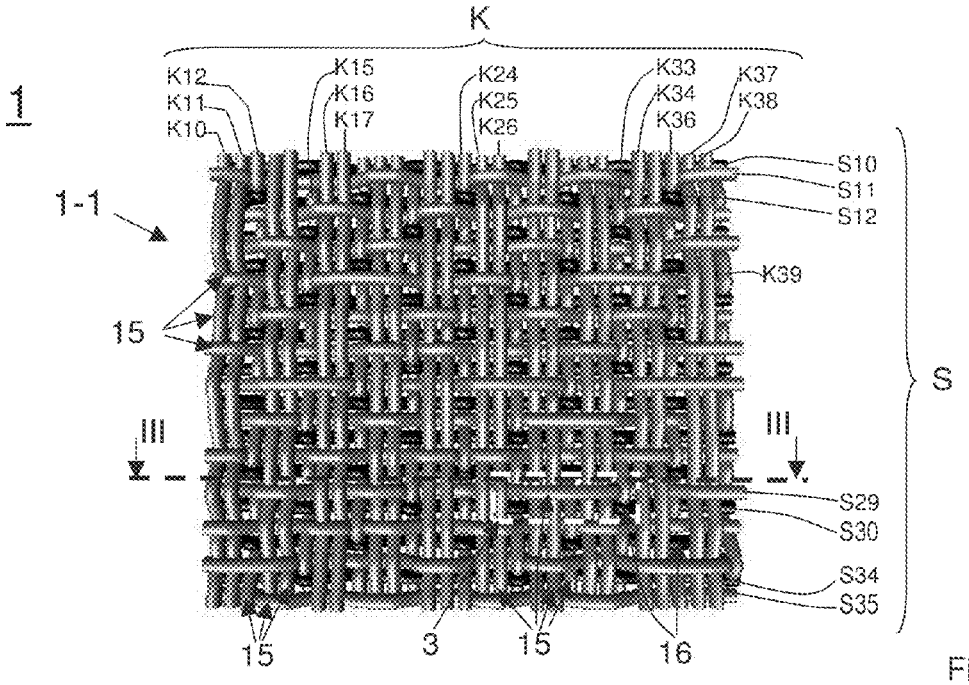
FIG. 2A shows a region of the textile substrate according to FIG. 1 in a first embodiment, with warp threads made of a first yarn and weft threads made of a first yarn and a second yarn, in a plan view from one side of the textile substrate.
Figure 2B:
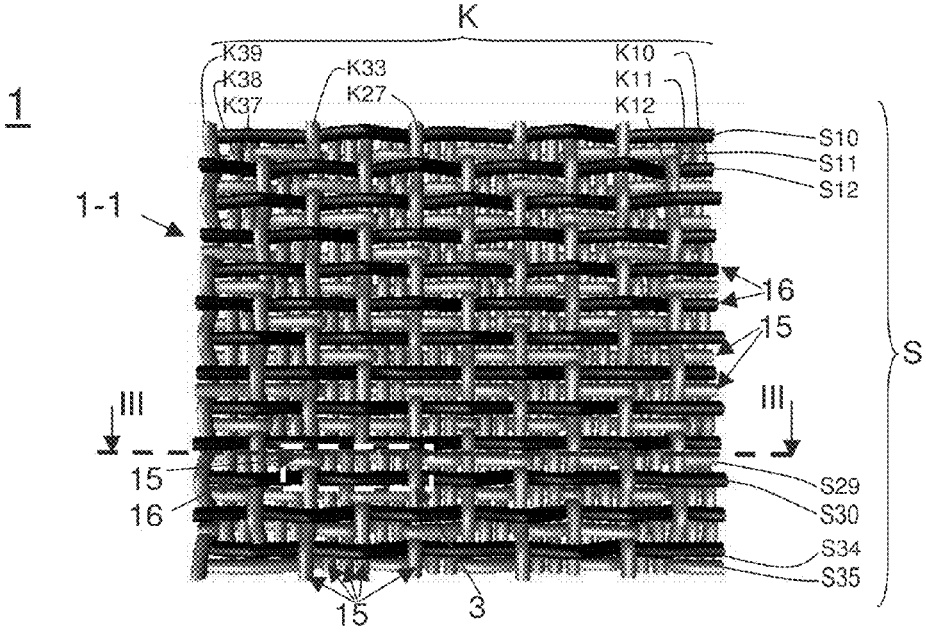
FIG. 2B shows the region of the textile substrate according to FIG. 2A, but in a plan view from the other side.

FIG. 2A shows a region 1-1 of the textile substrate 1 shown in FIG. 1, in a plan view of the first surface 2-1 in direction of the arrow IIA, whilst FIG. 2B shows the region 1-1 of the textile substrate 1 in a plan view of the second surface 2-2 in the direction of the arrow IIB.

As FIGS. 2A and 2B indicate, the textile substrate 1 is composed of a warp K consisting of a plurality of warp threads Ki, and of a weft S consisting of a plurality of weft threads Sj, wherein the references i and j in this connection symbolize numbers which are used in order to number and appropriately identify the respective warp threads of the warp K and the respective weft threads of the weft S.

As can be seen from FIGS. 2A and 2B, the region 1-1 comprises the warp threads Ki with i=10, . . . , 39 and the weft threads Sj with j=10, . . . , 35, i.e. a total of 30 warp threads and 26 weft threads. As can be seen, each of the illustrated warp threads Ki crosses over a plurality of the illustrated weft threads Sj respectively at an intersection in such a way that at least individual longitudinal sections of the respective warp thread extend on the surface 2-1 and other individual longitudinal sections of the respective warp thread Ki extend on the surface 2-2. Correspondingly each of the illustrated weft threads Sj crosses over a plurality of the illustrated warp threads Ki respectively at an intersection in such a way that at least individual longitudinal sections of the respective weft thread Sj extend on the surface 2-1 and other individual longitudinal sections of the respective warp thread Ki extend on the surface 2-2. Accordingly all the warp threads and weft threads of the textile substrate are connected in such a way that the warp K and the weft S together form a layer.

As can be seen from FIGS. 2A and 2B, the textile substrate is made of a first yarn 15 and a second yarn 16. In this case in the present example all warp threads Ki of the warp K consist of the first yarn 15, wherein the respective warp thread Ki for example consists of a single first yarn 15 or may comprise a plurality of first yarns 15 which are worked to form a ply. On the other hand the weft S also comprises, in addition to weft threads which consist of the first yarn 15 (in the form of an individual first yarn 15 or a ply formed of a plurality of first yarns 15), weft threads which consist of the second yarn 16 (in the form of an individual second yarn 16 or a ply formed of a plurality of second yarns 16).

As can be seen from FIGS. 2A and 2B, at least in the region 1-1 the weft S consists alternately of a weft thread consisting of the first yarn 15 and a weft thread consisting of the second yarn 16, so that in each case a weft thread consisting of the first yarn 15 is disposed between two weft threads consisting of the second yarn 16.

The first yarn 15 is a three-component yarn which comprises fibers made of wool, fibers made of regenerated cellulose and at least one continuous fiber made of a synthetic material.

The second yarn 16 contains regenerated cellulose fibers, wherein the percentage of the mass ("proportion by mass") of the regenerated cellulose fibers respectively contained in the second yarn 16 as a proportion of the respective total mass of the second yarn 16 is greater than the percentage of the mass ("proportion by mass") of the respective second regenerated cellulose fibers contained in the first yarn 15 as a proportion of the respective total mass of the first yarn 15.

In FIGS. 2A and 2B the respective warp threads and weft threads are each shown as 3-dimensional objects in a plan view of the textile substrate 1, wherein curved surfaces of these objects are in each case shown with the aid of different shades of grey and the warp or weft threads respectively consisting of the first yarn 15 are in each case shown in a lighter shade of grey than the respective weft threads consisting of the second yarn 16.

In order to be able to characterize the properties of the respective warp threads, it is assumed below that each warp thread Ki in the region 1-1 is composed of a plurality of longitudinal sections disposed one after the other, the lengths of which are determined by the weft threads crossing the warp threads Ki, wherein the two (intersection) points at which two neighboring weft threads Sj and S(j+1) cross over the respective warp thread Ki in each case define the two ends of one of the respective longitudinal sections of the warp thread Ki.

In order to be able to characterize the properties of the respective weft threads, it is assumed below that each weft thread Sj in the region 1-1 is composed of a plurality of longitudinal sections disposed one after the other, the lengths of which are determined by the warp threads crossing the weft threads Sj, wherein the two (intersection) points at which two neighboring warp threads Ki and K(i+1) cross over the respective weft thread Sj in each case define the two ends of one of the respective longitudinal sections of the weft thread Sj.

With regard to one or more aspects of the present invention it is relevant in this connection that the above-mentioned longitudinal sections of the respective weft thread Sj are not identical with regard to their spatial arrangement relative to the surfaces 2-1 and 2-2: individual ones of these longitudinal sections of the respective weft thread Sj extend in this case between the two neighboring warp threads which cross over the respective longitudinal section of the weft thread Sj at the two ends thereof in such a way that one of the two ends of the longitudinal section lies on one of the surfaces 2-1 or 2-2 and the other of the two ends of the longitudinal section lies on the respective other one of the surfaces 2-1 or 2-2; on the other hand, other ones of these longitudinal sections of the respective weft thread Sj extend exclusively on one of the two surfaces 2-1 or 2-2, i.e. either exclusively on the surface 2-1 or exclusively on the surface 2-2.

As can be seen from FIG. 2A) and FIG. 2B, in the region 1-1 all weft threads (S11, S13, S15, S17, S19, S21, S23, S25, S27, S29, S31, S33 and S35) consisting of the first yarn 15 have the following asymmetry with regard to their configuration relative to the surfaces 2-1 and 2-2 of the textile substrate 1: In the case of each of the at least one weft threads consisting of the first yarn 15 the overall length of all those longitudinal sections which extend in the region 1-1 on the first surface 2-1 of the textile substrate 1 is greater than the overall length of all those longitudinal sections which extend in the region 1-1 on the second surface 2-2 of the textile substrate 1.

As can be seen from FIG. 2A and FIG. 2B, in the region 1-1 all weft threads (S10, S12, S14, S16, S18, S20, S22, S24, S26, S28, S30, S32 and S34) consisting of the second yarn 16 also have an asymmetry with regard to their configuration relative to the surfaces 2-1 and 2-2 of the textile substrate 1: In the case of each of the weft threads consisting of the second yarn 16 the overall length of all those longitudinal sections which extend in the region 1-1 on the first surface 2-1 of the textile substrate 1 is smaller than the overall length of all those longitudinal sections which extend in the region 1-1 on the second surface 2-2 of the textile substrate 1. As can be seen from FIG. 2A and FIG. 2B, none of the weft threads consisting of the second yarn 16 has a longitudinal section which on its overall length (i.e. between the intersections at which two neighboring warp threads cross over the respective weft thread) extends exclusively on the first surface 2-1 (the respective longitudinal sections of the respective weft threads consisting of the second yarn 16 extend either exclusively on the second surface 2-2 or have two ends of which one lies on the first surface 2-1 and the other on the second surface 2-2).

The above-mentioned asymmetry of the weft threads consisting of the first yarn 15 and the above-mentioned asymmetry of the weft threads consisting of the second yarn 16 are in each case inverse with regard to the first surface 2-1 and the second surface 2-2. In the present example this is shown in particular in that, of the part of the first surface 2-1 of the textile substrate 1 formed by weft threads in the region 1-1, more than 75% is formed by weft threads consisting of the first yarn 15 and less than 25% is formed by weft threads consisting of the second yarn 16 (see FIG. 2A), and in that, of the part of the second surface 2-2 of the textile substrate 1 formed by weft threads in the region 1-1, approximately 25% is formed by weft threads consisting of the first yarn 15 and approximately 75% is formed by weft threads consisting of the second yarn 16 (see FIG. 2B).

Figure 3:
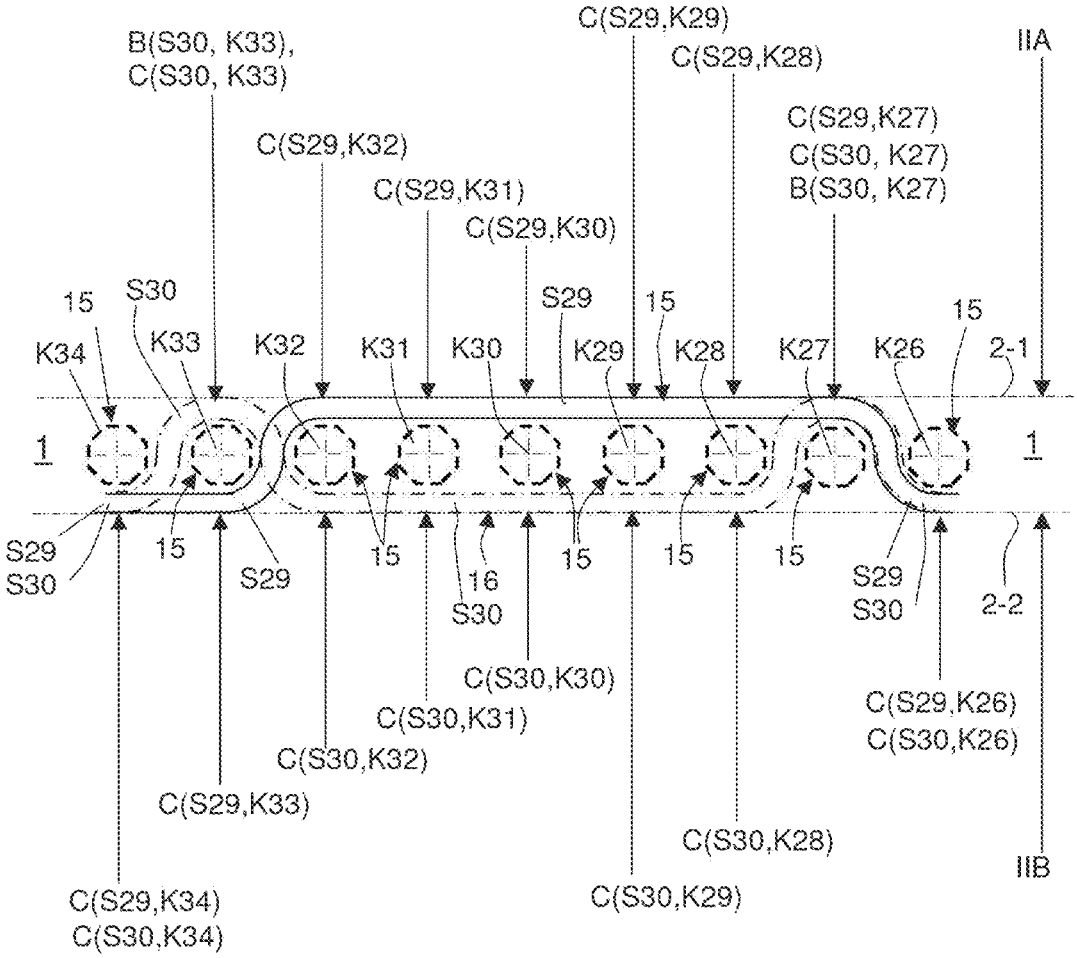
FIG. 3 shows a cross-section through the region of the textile substrate according to FIG. 2A or 2B along the line III-III in FIGS. 2A and 2B.

The above-mentioned asymmetries can also be seen with reference to FIG. 3. FIG. 3 shows a cross-section through the region 1-1 of the textile substrate 1 along the line III-III in FIGS. 2A and 2B; in this case only the section 3 of the region 1-1 of the textile substrate 1 is shown, which in FIG. 2A and FIG. 2B is delimited by the rectangle provided with the reference 3 and shown by white broken lines). FIG. 3 shows in particular the configuration of the weft thread S29 consisting of the first yarn 15 (the contours of this thread are shown in FIG. 3 by solid lines) and the configuration of the weft thread S30 consisting of the second yarn 16 (the contours of this thread are shown in FIG. 3 by broken lines) relative to 9 different warp threads K26, K27, K28, K29, K30, K31, K32, K33, K34. The above-mentioned warp threads Ki (with i=26, . . . , 34) extend in FIG. 3 in each case perpendicular to the drawing plane, wherein in FIG. 3 the outline of the cross-section of the respective warp thread Ki is shown as a broken circle and in the center of the respective circle a cross formed of broken lines is shown which marks the central longitudinal axis of the respective warp thread Ki.

In FIG. 3 the respective intersections at which the respective weft threads Sj (with j=29 or 30) cross the respective warp threads Ki (with i=26, . . . , 34) are also each characterized by a symbol "C(Sj, Ki)" and an arrow associated with the symbol "C(Sj, Ki)". In this case the symbol "C(Sj, Ki)")" identifies the intersection at which the weft thread Sj crosses the warp thread Ki, and the respective associated arrow marks the position of the respective intersection relative to the respective weft thread Sj (in FIG. 3 the position of the intersection C(Sj, Ki) is characterized: by the projection of the central longitudinal axis of the warp thread Ki onto the first surface 2-1 if the weft thread Sj at the intersection C(Sj, Ki) extends on the first surface 2-1, or alternatively by the projection of the central longitudinal axis of the warp thread Ki onto the second surface 2-2 if the weft thread Sj at the intersection C(Sj, Ki) extends on the second surface 2-2).

As can be seen from FIG. 3, the weft thread S29 consisting of the first yarn 15 in the section 3 of the region 1-1 in each case has eight longitudinal sections which extend between a respective two neighboring intersections of the intersections C(S29, K26), C(S29, K27), C(S29, K28), C(S29, K29), C(S29, K30), C(S29, K31), C(S29, K32), C(S29, K33) and C(S29, K34). Of these eight longitudinal sections a total of five longitudinal sections extend exclusively on the first surface 2-1 (this applies to all those longitudinal sections which extend between the intersections C(S29, K27) and C(S29, K32)) and one longitudinal section extends exclusively on the second surface 2-2 (this applies to the longitudinal section extending between the intersections C(S29, K33) and C(S29, K34)).

On the other hand two of the eight above-mentioned longitudinal sections extend over a part of their length on the first surface 2-1 and over another part of their length on the second surface 2-2: the latter applies to the longitudinal section which extends between the intersections C(S29, K32) and C(S29, K33) and the longitudinal section extending between the intersections C(S29, K26) and C(S29, K27).

The difference Δ(S29) between the overall length of all sections of the weft thread S29 which extend on the first surface 2-1 and the overall length of all sections of the weft thread S29 which extend on the second surface 2-2 may be considered as a quantitative measure for the asymmetry which characterizes the configuration of the weft thread S29 between the first surface 2-1 and the second surface 2-2. The longitudinal section which extends between the intersections C(S29, K32) and C(S29, K33) and the longitudinal section which extends between the intersections C(S29, K26) and C(S29, K27) make no contribution to this difference Δ(S29), particularly since each of these two longitudinal sections extends with equal parts of its length on the first surface 2-1 and on the second surface 2-2. Consequently the difference Δ(S29) is identical to the difference of the overall length of all sections of the weft thread S29 which extend exclusively on the first surface 2-1 and the overall length of all sections of the weft thread S29 which extend exclusively on the second surface 2-2. Accordingly the difference Δ(S29) in the present example—based on section 3 of the region 1-1 of the textile substrate 1—is the difference between the length of those five longitudinal sections which extend between the intersections C(S29, K27) and C(S29, K32) and the length of the one longitudinal section which extends between the intersections C(S29, K33) and C(S29, K34). The computation of the difference Δ(S29) described above can be carried out analogously for the configuration of the weft thread S29 in the region 1-1 with the result that Δ(S29)>0.

As can be seen from FIG. 3, the weft thread S30 consisting of the second yarn 16 has in the section 3 of the region 1-1, analogously to the weft thread S29, eight longitudinal sections which extend between a respective two neighboring intersections of the intersections C(S30, K26), C(S30, K27), C(S30, K28), C(S30, K29), C(S30, K30), C(S30, K31), C(S30, K32), C(S30, K33) and C(S30, K34). Of these eight longitudinal sections a total of four longitudinal sections extend exclusively on the second surface 2-2 (this applies to all those longitudinal sections which extend between the intersections C(S30, K28) and C(S30, K32)), whilst no longitudinal section extends exclusively on the first surface 2-1.

On the other hand four of the eight above-mentioned longitudinal sections extend over a part of their length on the first surface 2-1 and over another part of their length on the second surface 2-2: This latter applies to the longitudinal section which extends between the intersections C(S30, K26) and C(S30, K27), the longitudinal section which extends between the intersections C(S30, K27) and C(S30, K28), the longitudinal section which extends between the intersections C(S30, K32) and C(S30, K33) and the longitudinal section which extends between the intersections C(S30, K33) and C(S30, K34).

The difference Δ(S30) between the overall length of all sections of the weft thread S30 which extend on the first surface 2-1 and the overall length of all sections of the weft thread S30 which extend on the second surface 2-2 may be considered as a quantitative measure for the asymmetry which characterizes the configuration of the weft thread S30 between the first surface 2-1 and the second surface 2-2. The four longitudinal sections which extend between the intersections C(S30, K26) and C(S30, K27), or between the intersections C(S30, K27) and C(S30, K28), or between the intersections C(S30, K32) and C(S30, K33) or between the intersections C(S30, K33) and C(S30, K34) make no contribution to this difference Δ(S30), particularly since each of these longitudinal sections extends with equal parts of its length on the first surface 2-1 and on the second surface 2-2. Consequently the difference Δ(S30) is identical to the difference of the overall length of all sections of the weft thread S30 which extend exclusively on the first surface 2-1 and the overall length of all sections of the weft thread S30 which extend exclusively on the second surface 2-2. Accordingly the difference Δ(S30) in the present example—based on section 3 of the region 1-1 of the textile substrate 1—is the negative value of the length of those four longitudinal sections which extend between the intersections C(S30, K28) and C(S30, K32). The computation of the difference Δ(S30) described above can be carried out analogously for the configuration of the weft thread S30 in the region 1-1 with the result that Δ(S30)<0.

As can also be seen from FIG. 3, the weft thread S30 has a weave point in each case both on the warp thread K27 and also on the warp thread K33. These weave points are designated in FIG. 3 by the symbols B(S30, K27) or B(S30, K33) and have the same position as the intersections C(S30, K27) or C(S30, K33). As can be seen from FIGS. 2A and 2B, the weft thread S30 has further weave points. Correspondingly all the other weft threads consisting of the second yarn 16 in the region 1-1 have a plurality of weave points.

Figure 4:
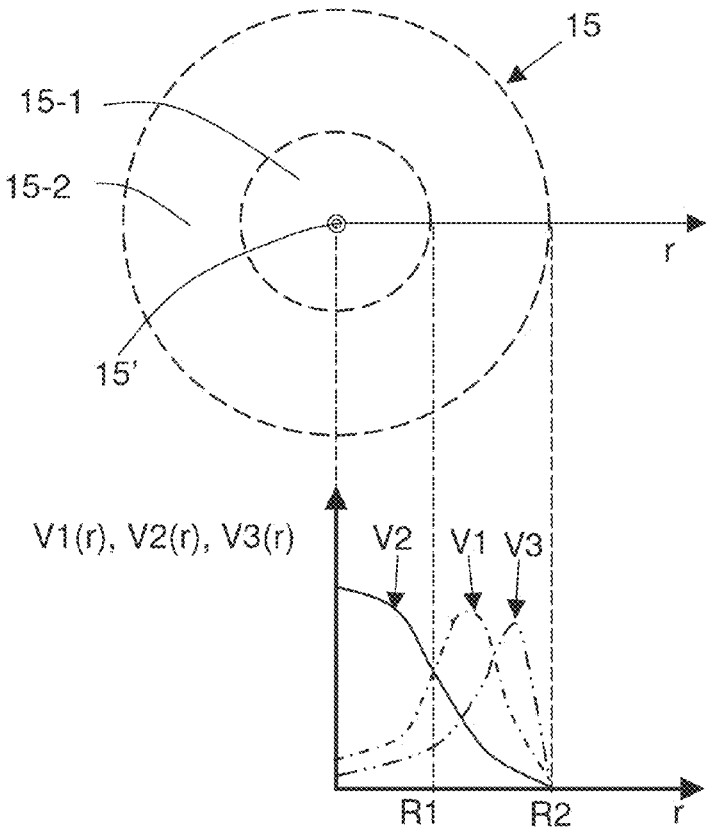
FIG. 4 shows a cross-section through the first yarn according to FIG. 2A.

The structure of a preferred embodiment of a first yarn 15 is explained below with reference to FIG. 4. FIG. 4 shows a cross-section of the first yarn 15 and the spatial distribution of the respective first fibers (made of wool), second fibers (made of regenerated cellulose) and third fibers (continuous fibers made of a synthetic material) contained in this yarn. The first yarn 15 has a central longitudinal axis 15' extending in the longitudinal direction of the yarn 15, wherein an outer contour of the cross-section is shown in FIG. 4 by a broken circle which surrounds the central longitudinal axis 15' with a radius R2. As can be seen from FIG. 4, the first yarn 15 has a core zone 15-1 surrounding the central longitudinal axis 15' and extending along the central longitudinal axis 15' and an outer zone 15-2 surrounding the core zone 15-1 and extending along the central longitudinal axis 15'. The outer contour of the core zone 15-2 is shown in FIG. 4 as a broken circle with a radius R1 around the central longitudinal axis 15'. FIG. 4 also shows—in a schematic representation in each case as a function of the radial spacing r from the central longitudinal axis 15'—the concentration V1(*r*) of the first fibers, the concentration V2(*r*) of the second fibers and the concentration V3(*r*) of the third fibers.

According to FIG. 4 the respective first fibers, the respective second fibers and the respective third fibers are spatially distributed over the cross-section of the first yarn in such a way that the concentration V2(*r*) of the second fibers in the core zone 15-1 is greater than in the outer zone 15-2 and the concentration V1(*r*) of the first fibers in the outer zone 15-2 is greater than in the core zone 15-1 and the concentration V3(*r*) of the third fibers in the outer zone 15-2 is greater than in the core zone 15-1.

In this case the concentration V2(*r*) of the second fibers (regenerated cellulose) is greatest in the middle the core zone 15-1, whilst the concentration V3(*r*) of the third fibers (continuous fiber made of a synthetic material) is greatest in the vicinity of the outer contour of the outer zone 15-2. The first yarn 15 according to FIG. 4 has the property that water can be absorbed principally in the core zone 15-1, whilst the outer zone 15-2 generally dries quickly. The first yarn 15 with the spatial distributions of the respective fibers given in FIG. 4 can be created for example in that fibers made of wool are spun intimately with staple fibers made of regenerated cellulose with a textured continuous polymer yarn being worked in simultaneously. The staple fibers made of regenerated cellulose can in this case have approximately the same length as the fibers made of wool. During spinning of the respective fibers the different qualities of the surfaces of the fibers can be taken into consideration. The staple fibers made of regenerated cellulose generally have a smoother surface and are less curly than the wool fibers and than the fibers of the textured polymer yarn which are generally tangled. During spinning, the fibers made of regenerated cellulose tend increasingly to lie in the middle of the yarn, whilst the tangled fibers of the textured polymer yarn and the fibers made of wool tend increasingly to be arranged in the outer zone 15-2 of the first yarn 15. A plurality of single yarns of the above-mentioned type can also be twisted to form plies.

FIGS. 5A-5C and FIG. 6 illustrate reactions of a textile substrate 1 according to FIGS. 1-3 to moisture in the form of (liquid) water and water vapor. The reactions illustrated in FIGS. 5A-5C and FIG. 6 have been determined experimentally with the aid of a textile substrate 1 in which the first yarn 15 consisted of 40% by weight of wool, 35% by weight of regenerated cellulose in the form of viscose and 15% by weight of polyamide (in the form of a textured continuous polyamide yarn) and the second yarn 16 of which 100% by weight consisted of regenerated cellulose in the form of viscose. The warp and weft threads consisting of the first yarn 15 were in this case produced as a ply which was twisted out of a plurality of first yarns 15 respectively present as single yarns. In this case the respective first yarn 15 was produced in such a way that—as indicated in FIG. 4—the concentration of the respective fibers made of regenerated cellulose (viscose) is greatest in a core zone (15-1 in FIG. 4) of the first yarn 15 and the concentration of the respective fibers made of wool and polyamide is greatest in an outer zone (15-2 in FIG. 4) of the first yarn 15. The regenerated cellulose fibers used for the production of the first yarn 15 were present as staple fibers of which the fiber length corresponds approximately to the fiber length of the fibers made of wool which are present in the first yarn. The warp and weft threads consisting of the first yarn 15 were in each case produced as a mixed yarn Nm 36/2. Threads of this type can be ordered from commercial worsted yarn spinning mill under the heading "Covergarn", e.g. from businesses belonging to the "Wagenfelder Spinning Group" (Wagenfelder Spinnereien GmbH, D-49419 Wagenfeld, Germany). The weft threads consisting of the second yarn 16 were produced as standardized staple yarn Nm 18.

Figure 5A:
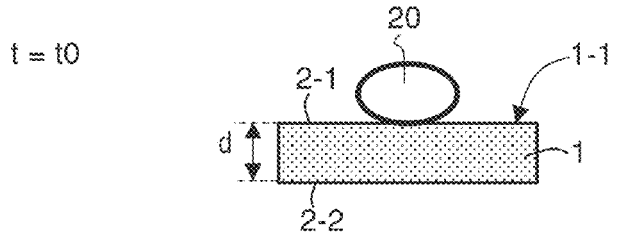
FIG. 5 shows a cross-section through a textile substrate according to the invention and a spatial distribution of water (in liquid form) in the textile substrate as a function of time, with a drop of water on a surface of the textile substrate at a starting time t=t0 (FIG. 5A) and a representation of the spread of the water contained in the drops in the textile substrate at later times t1 (FIG. 5B) and t2 (FIG. 5C)
Figure 5B:
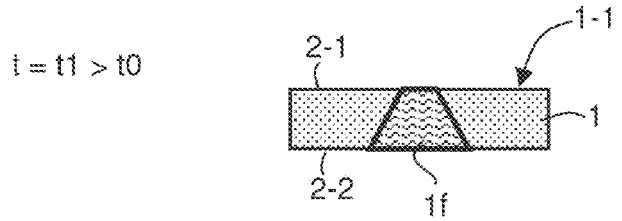
Figure 5C:
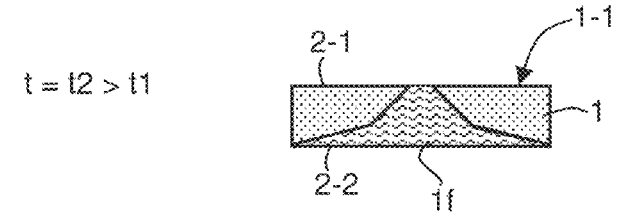

FIGS. 5A-5C illustrate the reaction of a textile substrate 1 of the above-mentioned type to water, which in the liquid state in the region 1-1 strikes the first surface 2-1 of the textile substrate 1, as a function of time t. In this case FIG. 5A—as a starting point at a time t=t0 shows a drop of water 20 which is brought into contact with the surface 2-1 of the textile substrate, wherein the textile substrate 1 is shown in cross-section. As FIG. 5B indicates, the water contained in the drop of water first of all penetrates through the surface 2-1 into the textile substrate 1 and is transported substantially perpendicularly to the surfaces 2-1 and 2-2, so that at a time t1>t0 the water reaches the surface 2-2 without immediately spreading on the first surface 2-1 parallel to the first surface 2-1: In FIG. 5B the surface designated by if denotes the region of the cross-section of the textile substrate 1 in which the water has been distributed up to the time t1. When the time advances to a time t2>t1, then transport of the water takes place substantially on the second surface 2-2, wherein the water is quickly distributed in two dimensions along the second surface 2-2, whilst immediately on the first surface 2-1 no significant spread of the water takes place parallel to the first surface 2-1 (the surface designated by 1*f* in FIG. 5C indicates the region of the cross-section of the textile substrate 1 in which the water has been distributed up to the time t2). The transport of the water within the textile substrate 1 illustrated in FIGS. 5A-5C is driven substantially by the quick absorption of water in the weft fibers consisting of the second yarn 16 (containing regenerated cellulose fibers) and the spatial arrangement of these weft fibers within the textile substrate 1. The state shown in FIG. 5C is already established after a few seconds, wherein the first surface 2-1 already feels dry after a few seconds, whilst the water is visibly and perceptibly concentrated and spreads on the second surface 2-2. It can be seen here that the water—starting from the first surface 2-1—is not distributed symmetrically relative to the two surfaces 2-1 and 2-2 in the textile substrate 1 and the distribution of the water within the region 1*f* of the textile substrate 1 in particular has a gradient which is directed from the first surface 2-1 to the second surface 2-2 and in the direction of the second surface 2-2 becomes progressively greater as a function of the distance from the first surface 2-1 in the direction of the second surface 2-2.

Figure 6:
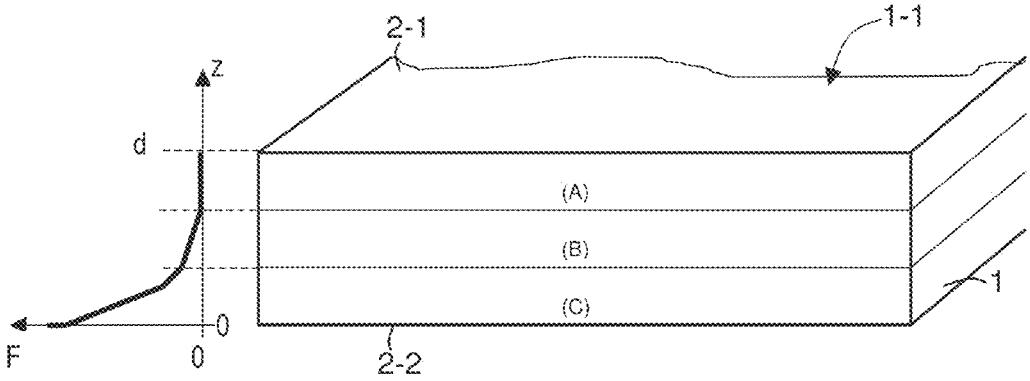
FIG. 6 shows a cross-section through a textile substrate according to one or more aspects of the invention and distribution of moisture in the textile substrate after application of water vapor to the textile substrate on one side of the textile substrate.

FIG. 6 illustrates the reaction of a textile substrate 1 of the above-mentioned type to an atmosphere containing water vapor which borders on the first surface 2-1 of the textile substrate 1 in the entire region 1-1. In this case water vapor can penetrate through the first surface 2-1 into the textile substrate 1 and can spread within the textile substrate 1. The distribution by moisture (condensed water and optionally water vapor) within the region 1 of the textile substrate 1 for different times as a function of the location was measured by means of computer tomography.

FIG. 6 shows a schematically representation of a cross-section of the textile substrate 1 in combination with a diagram which shows schematically the moisture F which is present in the textile substrate and is measured at a certain time as a function of the distance z from the second surface 2-2. As the measured progression F(z) of the moisture indicates, the moisture is distributed as a function of the distance z within the textile substrate 1 between the first surface 2-1 and the second surface 2-2 substantially in three "layers" which are in each case disposed one above another and perpendicular relative to the second surface 2-2 and extend in each case parallel to the first surface 2-1 or to the second surface 2-2. These three layers are illustrated schematically in FIG. 6 as layers (A), (B) and (C) which are shown in the representation of the textile substrate 1 and are in particular characterized in that they exhibit characteristic differences with regard to the distribution of the moisture, so that the moisture is distributed asymmetrically over the layers (A), (B) and (C). As the measured progression F(z) of the moisture according to FIG. 6 indicates, the layer (A) adjoining the first surface 2-1 is characterized in that it contains no measurable moisture so that it may be regarded as dry. The middle layer (B) (adjoining the layers (A) and (C)) has a moisture which decreases linearly as a function of the distance z in the direction of the surface 2-1 and accordingly has a gradient which is directed onto the second surface 2-2 and is constant within the layer (B). In the layer (C) adjoining the second surface 2-2 the moisture increases very progressively as a function of the distance z in the direction of the surface 2-2. Accordingly the moisture F(z) within the layer (C) has a gradient which is directed onto the second surface 2-2 and becomes greater within the layer (C) in the direction of the surface 2-2.

In this case in the present example the moisture in the layer (A) is approximately 0%, in the layer (B) approximately 2-4% (averaged over the layer (B)) and in the layer (C) approximately 8-12% (averaged over the layer (C)). In this case it is apparent that because of the design of the textile substrate 1 according to the invention this asymmetric distribution of the moisture can be kept constant. The layer (C) can absorb moisture up to the saturation limit, wherein a concentration of the moisture takes place in the layer (C) up to the saturation limit, whilst the layer (A) remains constantly dry. In order to be able to maintain this asymmetric distribution of the moisture for any length of time, it is possible to transport moisture away through the surfaces 2-2 out of the layer (C). The moisture contained in the layer (B) ensures a controlled evaporation of moisture over the first surface 2-1 and enables metered cooling of the textile substrate 1 in the region of the first surface 2-1.

This layering of the moisture results inter alia from the fact that the fibers made of regenerated cellulose present in the textile substrate 1 (in comparison to the other fibers present in the textile substrate) have an extremely high absorption rate for water and moreover they are present on the first surface 2-1 in a lower concentration than on the second surface 2-2. Moreover on the first surface 2-1 in the region of the layer (A) fibers made of polyamide and wool are present in a relatively high concentration which promotes relatively quick drying of the textile substrate 1 within the layer (A). In order that the above-mentioned layering of the moisture can be kept constant, it is relevant that moisture can be exchanged efficiently between the different fibers present in the textile substrate 1. In order that this exchange of moisture takes place efficiently, a low resistance to water vapor permeability $R_{ct}$ and a relatively low thermal resistance $R_{ct}$ are conducive.

As a comparison of FIG. 3 and FIG. 6 indicates, predominantly warp threads, in the present example warp threads made of the first yarn 15 extend within the (middle) layer (B) (averaged over the layer): As FIG. 3 indicates, the weft thread consisting of the first yarn 15 extends at least in sections (e.g. between the two intersections C(S29, K33) and C(S29, K32) and the two intersections C(S29, K26) and C(S29, K27)) also through the layer (B) and likewise the weft thread S30 consisting of the second yarn 16 extends at least in sections (e.g. between the intersections C(S30, K26) and C(S30, K27), between the intersections C(S30, K27) and C(S30, K28), between the intersections C(S30, K32) and C(S30, K33) and between the intersections C(S30, K33) and C(S30, K34)) also through the layer (B); however, the weft threads consisting of the first yarn 15 or the second yarn 16—in comparison with the warp threads—include a relatively small part of the layer (B). The concentration of the moisture in the layer (B) in the present example is substantially determined by the moisture contained in the warp threads. As a comparison of FIG. 3 and FIG. 6 indicates, predominantly weft threads made of the second yarn 16 extend within the layer (C) (averaged over the layer), so that the concentration of the moisture in the layer (C) is determined substantially by the moisture which is contained in the weft threads consisting of the second yarn 16. Correspondingly, predominantly weft threads made of the first yarn 15 extend within the layer (A) (averaged over the layer), so that the concentration of the moisture in the layer (A) is determined substantially by the moisture which is contained in the weft threads consisting of the first yarn 15.

The textile substrate illustrated in FIGS. 1-6 was produced for example with a warp thread density of 36 warp threads per cm and a weft thread density of 16 weft threads per cm. This results in a resistance to water vapor permeability with a $R_{et}$ value <6 $m^2$ Pa/W (this corresponds to the definition "extremely breathable" relative to textile substrates) and a thermal resistance $R_{ct}$<19 $10^{-3}$ $m^2K/W$.

The textile substrate illustrated in FIGS. 1-6 can be modified in many ways within the context of the invention. For example the composition of the respective warp and weft threads, the arrangement of the respective fibers in the warp and weft threads and the arrangement of the respective warp and weft threads in the textile substrate are varied.

Figure 7A:
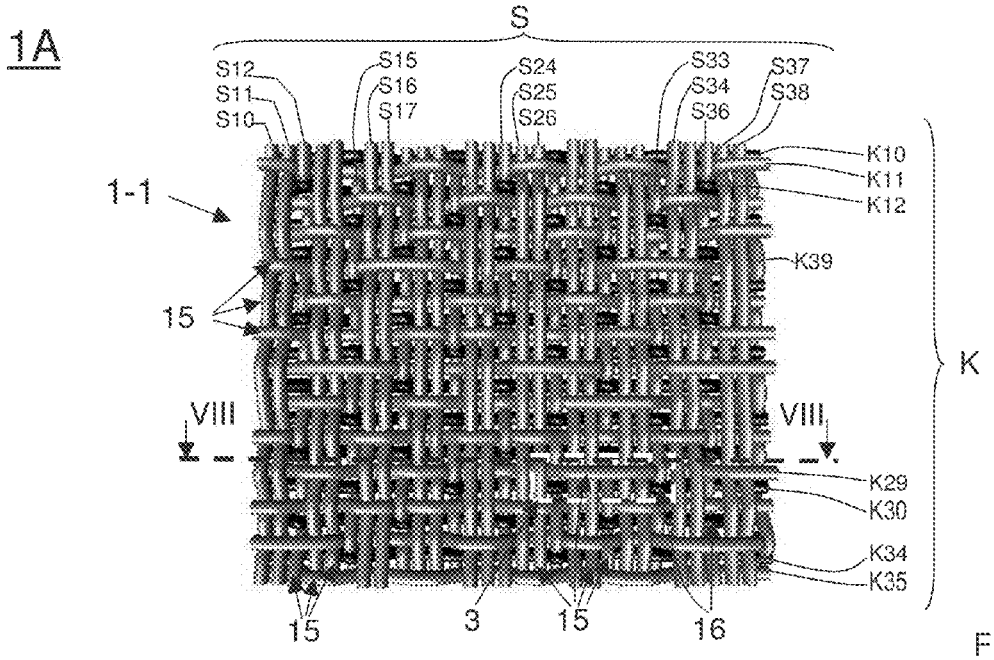
FIG. 7A shows a region of the textile substrate according to FIG. 1 in a second embodiment, with weft threads made of a first yarn and warp threads made of a first yarn and a second yarn, in a plan view from one side of the textile substrate.
Figure 7B:
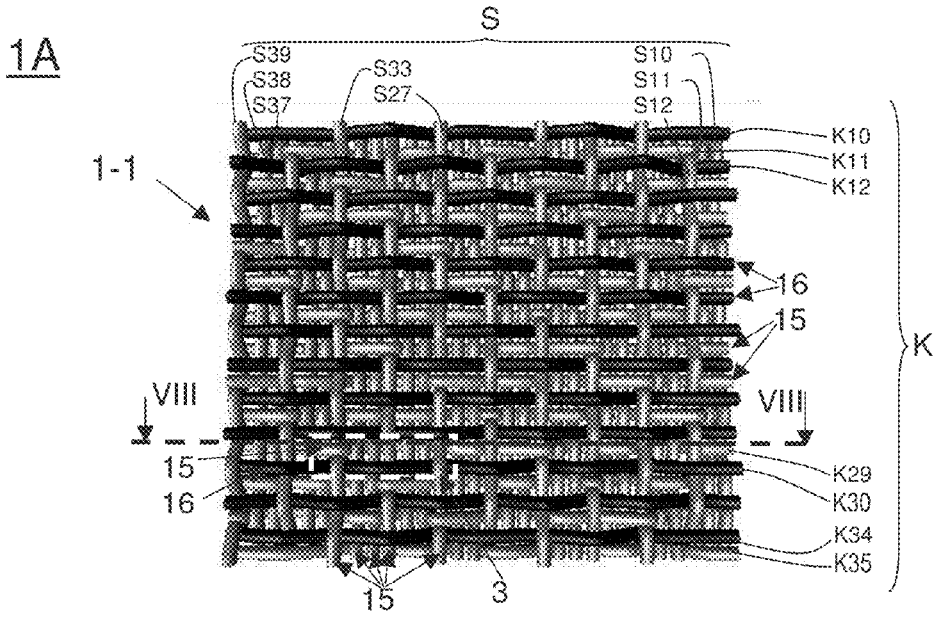
FIG. 7B shows the region of the textile substrate according to FIG. 7A, but in a plan view from the other side.
Figure 8:
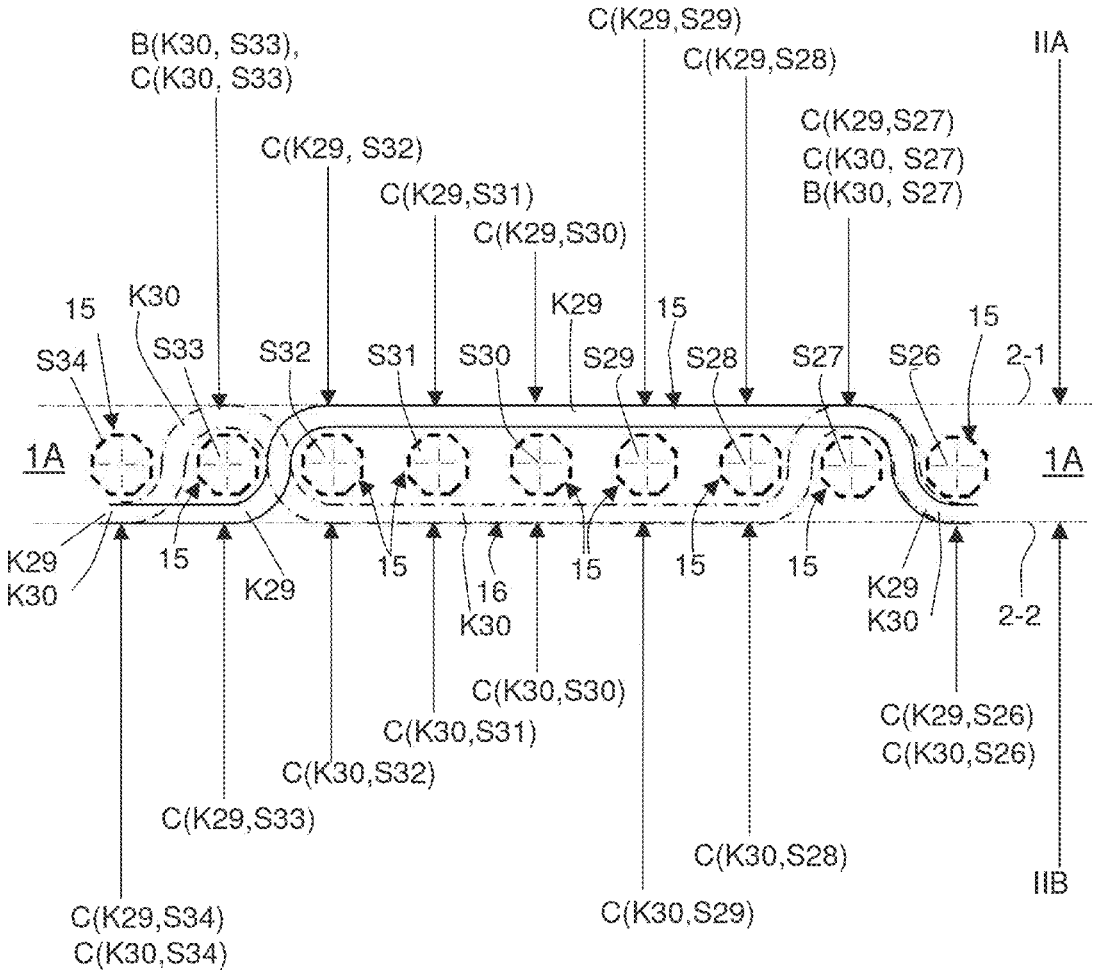
FIG. 8 shows a cross-section through the region of the textile substrate according to FIG. 7A or 7B along the line VIII-VIII in FIGS. 7A and 7B.

FIGS. 7A, 7B and 8 show a textile substrate according to the invention according to the second example, which is designated below—in order to distinguish it from the textile substrate 1—by the reference 1A. With regard to a number of details the textile substrate 1A has features in common with the textile substrate 1 according to FIGS. 1-6. Accordingly in FIGS. 1-8 those details of the textile substrates 1 and 1A which are provided with references and which are the same or have the same functions are in each case provided with the same references. Primarily the differences between the textile substrates 1A and 1 are explained below.

In the views according to FIGS. 7A, 7B and 8 it is assumed that the textile substrate 1A is present in the form of a fabric which in the present example extends parallel to one plane (like the textile substrate 1 according to the view in FIG. 1). In this case the textile substrate 1A forms a flat layer with the thickness d and has a first surface 2-1 and a second surface 2-2 opposite the first surface 2-1. In FIG. 8 an arrow IIA points perpendicularly to the first surface 2-1, and an arrow IIB points perpendicularly to the second surface 2-2.

FIG. 7A shows a region 1-1 of the textile substrate 1A in a plan view of the first surface 2-1 in direction of the arrow IIA, whilst FIG. 7B shows the region 1-1 of the textile substrate 1 in a plan view of the second surface 2-2 in the direction of the arrow IIB. In this case it is assumed that the range 1-1 of the textile substrate 1A forms a rectangular section of the textile substrate 1A forms (corresponding to the region 1-1 of the textile substrate 1 according to FIG. 1). In this case the region 1-1 can encompass any proportion of the textile substrate 1A, i.e. the region 1-1 can encompass the textile substrate 1A as a whole.

As FIGS. 7A and 7B indicate, the textile substrate 1A is formed as a fabric which is composed of a warp K consisting of a plurality of warp threads Kj, and of a weft S consisting of a plurality of weft threads Si, wherein the references j and i in this connection symbolize numbers which are used in order to number and appropriately identify the respective warp threads of the warp K and the respective weft threads of the weft S.

As can be seen from FIGS. 7A, 7B and 8, the region 1-1 of the textile substrate 1A comprises the weft threads Si with i=10, . . . , 39 and the warp threads Kj with j=10, . . . , 35, i.e. a total of 30 weft threads and 26 warp threads. As can be seen, each of the illustrated weft threads Si crosses over a plurality of the illustrated warp threads Kj respectively at an intersection in such a way that at least individual longitudinal sections of the respective weft thread Si extend on the surface 2-1 and other individual longitudinal sections of the respective weft thread Si extend on the surface 2-2. Correspondingly each of the illustrated warp threads Kj crosses over a plurality of the illustrated weft threads Si respectively at an intersection in such a way that at least individual longitudinal sections of the respective warp thread Kj extend on the surface 2-1 and other individual longitudinal sections of the respective weft thread Si extend on the surface 2-2. Accordingly all the warp threads and weft threads of the textile substrate 1A are connected in such a way that the warp K and the weft S together form a layer.

As can also be seen from FIGS. 7A and 7B, the textile substrate 1A is made of a first yarn 15 and a second yarn 16. In this case it is assumed that each yarn 15 of the textile substrate 1A is identical to a yarn 15 of the textile substrate 1 and each yarn 16 of the textile substrate 1A is identical to a yarn 16 of the textile substrate 1. Accordingly each yarn 15 of the textile substrate 1A can be formed according to the same specifications as a yarn 15 of the textile substrate 1 and each yarn 16 of the textile substrate 1A can be formed according to the same specifications as a yarn 16 of the textile substrate 1.

The respective first yarn 15 of the textile substrate 1A is a three-component yarn which comprises fibers made of wool, fibers made of regenerated cellulose and at least one continuous fiber made of a synthetic material. Correspondingly the second yarn 16 of the textile substrate 1A contains regenerated cellulose fibers, wherein the percentage of the mass ("proportion by mass") of the regenerated cellulose fibers respectively contained in the second yarn 16 as a proportion of the respective total mass of the second yarn 16 is greater than the percentage of the mass ("proportion by mass") of the respective second regenerated cellulose fibers contained in the first yarn 15 as a proportion of the respective total mass of the first yarn 15.

Analogously with FIGS. 2A and 2B, in FIGS. 7A and 7B the respective warp threads and weft threads of the textile substrate 1A are each shown as 3-dimensional objects in a plan view of the textile substrate 1A, wherein curved surfaces of these objects are in each case shown with the aid of different shades of grey and the warp or weft threads respectively consisting of the first yarn 15 are in each case shown in a lighter shade of grey than the respective warp threads consisting of the second yarn 16.

The textile substrate 1A differs from the textile substrate 1 inter alia in that in the case of the textile substrate 1A all weft threads Si of the weft S consist of the first yarn 15, wherein the respective weft thread Si for example consists of a single first yarn 15 or may comprise a plurality of first yarns 15 which are worked to form a ply. On the other hand the warp K also comprises, in addition to warp threads which consist of the first yarn 15 (in the form of an individual first yarn 15 or a ply formed of a plurality of first yarns 15), warp threads which consist of the second yarn 16 (in the form of an individual second yarn 16 or a ply formed of a plurality of second yarns 16).

As can be seen from FIGS. 7A and 7B, in the case of the textile substrate 1A at least in the region 1-1 the warp K consists alternately of a warp thread consisting of the first yarn 15 and a warp thread consisting of the second yarn 16, so that in each case a warp thread consisting of the first yarn 15 is disposed between two warp threads consisting of the second yarn 16.

As a comparison between FIG. 7A and FIG. 2A and a comparison between FIG. 7B and FIG. 2B shows, the textile substrate 1A differs from the textile substrate primarily in that the arrangement or the function of the respective warp threads in the textile substrate 1A correspond to the arrangement or the function of the respective weft threads in the textile substrate 1 and the arrangement or the function of the respective weft threads in the textile substrate 1A correspond to the arrangement or the function of the respective warp threads in the textile substrate 1. As can be seen, each warp thread Kj (with j=10, . . . , 35) of the textile substrate 1A has the same spatial arrangement as the corresponding weft thread Sj (with j=10, . . . , 35) of the textile substrate 1 and each weft thread Si (with i=10, . . . , 39) of the textile substrate 1A has the same spatial arrangement as the corresponding warp thread Ki (with i=10, . . . , 39) of the textile substrate 1. Furthermore, each warp thread Kj (with j=10, . . . , 35) of the textile substrate 1A has the same material composition as the corresponding weft thread Sj (with j=10, . . . , 35) of the textile substrate 1: The warp thread Kj with j=10, 12, 14, 16, 18, 20, 22, 24, 26, 28, 30, 32 and 34 of the textile substrate 1A, like the corresponding weft thread Sj with j=10, 12, 14, 16, 18, 20, 22, 24, 26, 28, 30, 32 and 34 of the textile substrate 1, consists of the second yarn 16; correspondingly the warp thread Kj with j=11, 13, 15, 17, 19, 21, 23, 25, 27, 29, 31, 33 and 35 of the textile substrate 1A, like the corresponding weft thread Sj with j=11, 13, 15, 17, 19, 21, 23, 25, 27, 29, 31, 33 and 35 of the textile substrate 1, consists of the first yarn 15. Furthermore, each weft thread Si (with j=10, . . . , 35) of the textile substrate 1A has the same material composition as the corresponding warp thread Ki (with j=10, . . . , 35) of the textile substrate 1: each weft thread Si (with i=10, . . . , 39) of the textile substrate 1A, like the corresponding warp thread Ki (with i=10, . . . , 39) of the textile substrate 1, consists of the first yarn 15.

In order to be able to characterize the properties of the respective weft threads of the textile substrate 1A, it is assumed below that each weft thread Si in the region 1-1 is composed of a plurality of longitudinal sections disposed one after the other, the lengths of which are determined by the warp threads crossing the weft threads Si, wherein the two (intersection) points at which two neighboring warp threads Kj and K(j+1) cross over the respective weft thread Si in each case define the two ends of one of the respective longitudinal sections of the weft thread Si.

In order to be able to characterize the properties of the respective warp threads of the textile substrate 1A, it is assumed below that each warp thread Kj in the region 1-1 is composed of a plurality of longitudinal sections disposed one after the other, the lengths of which are determined by the weft threads crossing the warp threads Kj, wherein the two (intersection) points at which two neighboring weft threads Si and S(i+1) cross over the respective warp thread Kj in each case define the two ends of one of the respective longitudinal sections of the warp thread Kj.

With regard to one or more aspects of the present invention it is relevant in this connection that the above-mentioned longitudinal sections of the respective warp thread Kj of the textile substrate 1A are not identical with regard to their spatial arrangement relative to the surfaces 2-1 and 2-2: individual ones of these longitudinal sections of the respective warp thread Kj extend in this case between the two neighboring weft threads which cross over the respective longitudinal section of the warp thread Kj at the two ends thereof in such a way that one of the two ends of the longitudinal section lies on one of the surfaces 2-1 or 2-2 and the other of the two ends of the longitudinal section lies on the respective other one of the surfaces 2-1 or 2-2; on the other hand, other ones of these longitudinal sections of the respective warp thread Kj extend exclusively on one of the two surfaces 2-1 or 2-2, i.e. either exclusively on the surface 2-1 or exclusively on the surface 2-2.

As can be seen from FIG. 7A and FIG. 7B, in the region 1-1 all warp threads (K11, K13, K15, K17, K19, K21, K23, K25, K27, K29, K31, K33 and K35) consisting of the second yarn 15 have the following asymmetry with regard to their configuration relative to the surfaces 2-1 and 2-2 of the textile substrate 1A: In the case of each warp thread consisting of the first yarn 15 the overall length of all those longitudinal sections which extend in the region 1-1 on the first surface 2-1 of the textile substrate 1A is greater than the overall length of all those longitudinal sections which extend in the region 1-1 on the second surface 2-2 of the textile substrate 1A.

As can be seen from FIG. 7A and FIG. 7B, in the region 1-1 of the textile substrate 1A all warp threads (K10, K12, K14, K16, K18, K20, K22, K24, K26, K28, K30, K32 and K34) consisting of the second yarn 16 also have an asymmetry with regard to their configuration relative to the surfaces 2-1 and 2-2 of the textile substrate 1A: In the case of each warp thread consisting of the second yarn 16 the overall length of all those longitudinal sections which extend in the region 1-1 on the first surface 2-1 of the textile substrate 1A is less than the overall length of all those longitudinal sections which extend in the region 1-1 on the second surface 2-2 of the textile substrate 1A. As can be seen from FIG. 7A and FIG. 7B, none of the warp threads consisting of the second yarn 16 has a longitudinal section which on its overall length (i.e. between the intersections at which two neighboring weft threads cross over the respective warp thread) extends exclusively on the first surface 2-1 (the respective longitudinal sections of the respective warp threads consisting of the second yarn 16 extend either exclusively on the second surface 2-2 or have two ends of which one lies on the first surface 2-1 and the other on the second surface 2-2).

The above-mentioned asymmetry of the warp threads consisting of the first yarn 15 and the above-mentioned asymmetry of the warp threads consisting of the second yarn 16 are in each case inverse with regard to the first surface 2-1 and the second surface 2-2. In the present example this is shown in particular in that, of the part of the first surface 2-1 of the textile substrate 1A formed by warp threads in the region 1-1, more than 75% is formed by warp threads consisting of the first yarn 15 and less than 25% is formed by warp threads consisting of the second yarn 16 (see FIG. 7A, and in that, of the part of the second surface 2-2 of the textile substrate 1A formed by warp threads in the region 1-1, approximately 25% is formed by warp threads consisting of the first yarn 15 and approximately 75% is formed by warp threads consisting of the second yarn 16 (see FIG. 7B).

The above-mentioned asymmetries can also be seen with reference to FIG. 8. FIG. 8 shows a cross-section through the region 1-1 of the textile substrate 1A along the line III-III in FIGS. 7A and 7B; in this case only the section 3 of the region 1-1 of the textile substrate 1A is shown, which in FIG. 7A and FIG. 7B is delimited by the rectangle provided with the reference 3 (and shown by white broken lines). FIG. 8 shows in particular the configuration of the warp thread K29 consisting of the first yarn 15 (the contours of this thread are shown in FIG. 8 by solid lines) and the configuration of the warp thread K30 consisting of the second yarn 16 (the contours of this thread are shown in FIG. 8 by broken lines) relative to 9 different weft threads S26, S27, S28, S29, S30, S31, S32, S33, S34. The above-mentioned weft threads Si (with i=26, . . . , 34) extend in FIG. 8 in each case perpendicular to the drawing plane, wherein in FIG. 8 the outline of the cross-section of the respective weft thread Si is shown as a broken circle and in the center of the respective circle a cross formed of broken lines is shown which marks the central longitudinal axis of the respective weft thread Si.

In FIG. 8 the respective intersections at which the respective warp threads Kj (with j=29 or 30) cross the respective weft threads Si (with i=26, . . . , 34) are also each characterized by a symbol "C(Kj, Si)" and an arrow associated with the symbol "C(Kj, Si)". In this case the symbol "C(Kj, Si)"" identifies the intersection at which the warp thread Kj crosses the weft thread Si, and the respective associated arrow marks the position of the respective intersection relative to the respective warp thread Kj (in FIG. 8 the position of the intersection C(Kj, Si) is characterized: by the projection of the central longitudinal axis of the weft thread Si onto the first surface 2-1 if the warp thread Kj at the intersection C(Kj, Si) extends on the first surface 2-1, or alternatively by the projection of the central longitudinal axis of the weft thread Si onto the second surface 2-2 if the warp thread Kj at the intersection C(Kj, Si) extends on the second surface 2-2).

As can be seen from FIG. 8, the warp thread K29 consisting of the first yarn 15 in the section 3 of the region 1-1 in each case has eight longitudinal sections which extend between a respective two neighboring intersections of the intersections C(K29, S26), C(K29, S27), C(K29, S28), C(K29, S29), C(K29, S30), C(K29, S31), C(K29, S32), C(K29, S33) and C(K29, S34). Of these eight longitudinal sections a total of five longitudinal sections extend exclusively on the first surface 2-1 (this applies to all those longitudinal sections which extend between the intersections C(K29, S27) and C(K29, S32) and one longitudinal section extends exclusively on the second surface 2-2 (this applies to the longitudinal section extending between the intersections C(K29, S33) and C(K29, S34)).

On the other hand two of the eight above-mentioned longitudinal sections extend over a part of their length on the first surface 2-1 and over another part of their length on the second surface 2-2: The latter applies to the longitudinal section extending between the intersections C(K29, S32) and C(K29, S33) and to the longitudinal section extending between the intersections C(K29, S26) and C(K29, S27).

The difference Δ(K29) between the overall length of all sections of the warp thread K29 which extend on the first surface 2-1 and the overall length of all sections of the warp thread K29 which extend on the second surface 2-2 may be considered as a quantitative measure for the asymmetry which characterizes the configuration of the warp thread K29 between the first surface 2-1 and the second surface 2-2. The longitudinal section which extends between the intersections C(K29, S32) and C(K29, S33) and the longitudinal section which extends between the intersections C(K29, S26) and C(K29, S27) make no contribution to this difference Δ(K29), particularly since each of these two longitudinal sections extends with equal parts of its length on the first surface 2-1 and on the second surface 2-2. Consequently the difference Δ(K29) is identical to the difference of the overall length of all sections of the warp thread K29 which extend exclusively on the first surface 2-1 and the overall length of all sections of the warp thread K29 which extend exclusively on the second surface 2-2. Accordingly the difference Δ(K29) in the present example—based on section 3 of the region 1-1 of the textile substrate 1A—is the difference between the length of those five longitudinal sections which extend between the intersections C(K29, S27) and C(K29, S32) and the length of the one longitudinal section which extends between the intersections C(K29, S33) and C(K29, S34). The computation of the difference Δ(K29) described above can be carried out analogously for the configuration of the warp thread K29 in the region 1-1 with the result that Δ(K29)>0.

As can be seen from FIG. 8, the warp thread K30 consisting of the second yarn 16 has in the section 3 of the region 1-1, analogously to the warp thread K29, eight longitudinal sections which extend between a respective two neighboring intersections of the intersections C(K30, S26), C(K30, S27), C(K30, S28), C(K30, S29), C(K30, S30), C(K30, S31), C(K30, S32), C(K30, S33) and C(K30, S34). Of these eight longitudinal sections a total of four longitudinal sections extend exclusively on the second surface 2-2 (this applies to all those longitudinal sections which extend between the intersections C(K30, S28) and C(K30, S32)), whilst no longitudinal section extends exclusively on the first surface 2-1.

On the other hand four of the eight above-mentioned longitudinal sections extend over a part of their length on the first surface 2-1 and over another part of their length on the second surface 2-2: This latter applies to the longitudinal section which extends between the intersections C(K30, S26) and C(K30, S27), the longitudinal section which extends between the intersections C(K30, S27) and C(K30, S28), the longitudinal section which extends between the intersections C(K30, S32) and C(K30, S33) and the longitudinal section which extends between the intersections C(K30, S33) and C(K30, S34).

The difference Δ(K30) between the overall length of all sections of the warp thread K30 which extend on the first surface 2-1 and the overall length of all sections of the warp thread K30 which extend on the second surface 2-2 may be considered as a quantitative measure for the asymmetry which characterizes the configuration of the warp thread K30 between the first surface 2-1 and the second surface 2-2. The four longitudinal sections which extend between the intersections C(K30, S26) and C(K30, S27), or between the intersections C(K30, S27) and C(K30, S28), or between the intersections C(K30, S32) and C(K30, S33) or between the intersections C(K30, S33) and C(K30, S34) make no contribution to this difference Δ(K30), particularly since each of these longitudinal sections extends with equal parts of its length on the first surface 2-1 and on the second surface 2-2. Consequently the difference Δ(K30) is identical to the difference of the overall length of all sections of the warp thread K30 which extend exclusively on the first surface 2-1 and the overall length of all sections of the warp thread K30 which extend exclusively on the second surface 2-2. Accordingly the difference Δ(K30) in the present example—based on section 3 of the region 1-1 of the textile substrate 1A—is the negative value of the length of those four longitudinal sections which extend between the intersections C(K30, S28) and C(K30, S32). The computation of the difference Δ(K30) described above can be carried out analogously for the configuration of the warp thread K30 in the region 1-1 with the result that Δ(K30)<0.

As can also be seen from FIG. 8, the weft thread K30 has a weave point in each case both on the warp thread S27 and also on the weft thread S33. These weave points are designated in FIG. 8 by the symbols B(K30, S27) or B(K30, S33) and have the same position as the intersections C(K30, S27) or C(K30, S33). As can be seen from FIGS. 7A and 7B, the weft thread K30 has further weave points. Correspondingly all the other warp threads consisting of the second yarn 16 in the region 1-1 have a plurality of weave points.

A comparison between FIGS. 3 and 8 shows that with regard to the warp threads K29 and K30 the textile substrate 1A has the same asymmetry as the weft threads S29 and S30 of the textile substrate 1.

Figure 9:
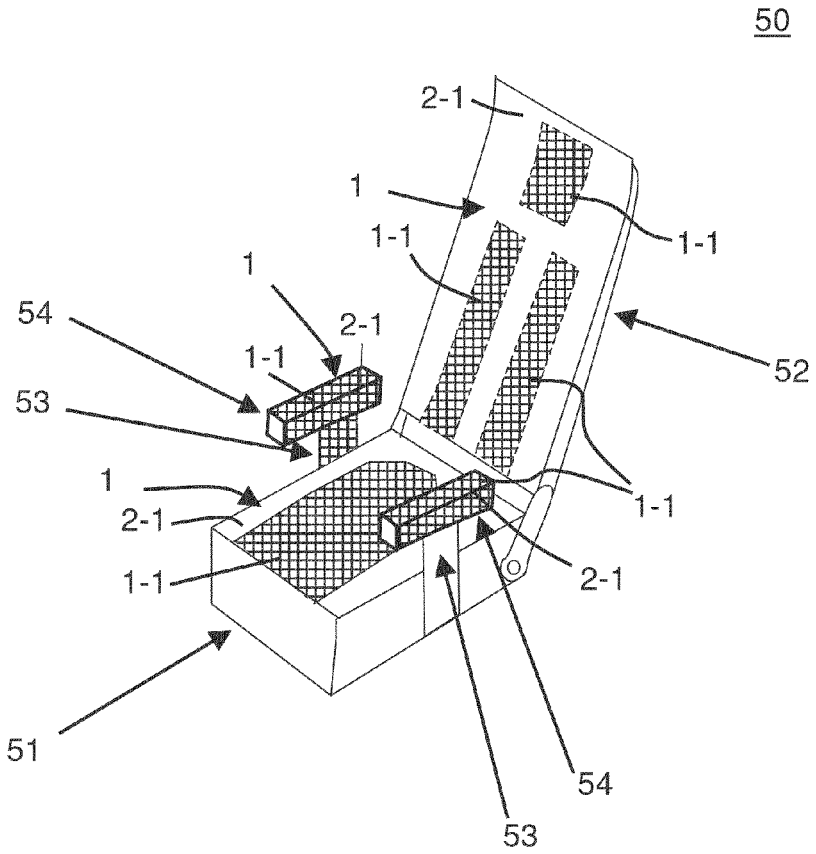
FIG. 9 shows a seat unit with outer surfaces which are formed by a surface of a textile substrate according to one or more aspects of the invention.

FIG. 9 shows a use of a textile substrate 1 according to the invention as a covering material for a seat unit 50. The seat unit 50 comprises a seat 51, a seat back 52, two side parts 53 and two armrests 54 each fastened to one of the side parts 53. As indicated by FIG. 9, the seat 51, the seat back 52, each of the two side parts 53 and each of the two armrests 54 are covered with a textile substrate 1 according to FIGS. 1-3 in such a way that the first surface 2-1 of the respective textile substrate 1 in each case forms an outer surface of the seat 51, the seat back 52, each of the two side parts 53 and each of the two armrests 54 and thus serves as the right side of the respective textile substrate 1, whilst the second surface 2-2 of the respective textile substrate 1 serves as the left side. In FIG. 9 the checkered surfaces in each case characterize the regions 1-1 of the surface of the seat unit 50 on which a person sitting on the seat unit 50 usually gives off moisture (water and water vapor) to the respective textile substrates 1 during long periods of sitting. In order to ensure air-conditioned seating at least those regions 1-1 of the respective textile substrates 1 according to FIG. 9 are designed like the region 1-1 of the textile substrate 1 according to FIGS. 1-3 shown in FIGS. 2A and 2B. Alternatively each textile substrate 1 according to FIG. 9 can naturally also be designed like the region 1-1 of the textile substrate 1 according to FIGS. 1-3 shown in FIGS. 2A and 2B. The seat unit 51 can be formed so that water can be wicked from the left side of the product of the respective textile substrate 1 into the interior of the seat unit 51. In this way it is ensured that the first surface 2-1 of the respective textile substrate 1 always remains dry even after long periods of sitting and the first surface 2-1 takes on a temperature close to the body temperature of the seated person.

The seat 51 according to FIG. 9 could also have a textile substrate 1A according to FIGS. 7A, 7B and 8 instead of the textile substrate 1. In this case the regions shown in FIG. 9 could be designed for example like the region 1-1 of the textile substrate 1A shown in FIGS. 7A and 7B, wherein the first surface 2-1 of the textile substrate 1A in each case forms an outer surface of the seat 51, the seat back 52, each of the two side parts 53 and each of the two armrests 54 and thus serves as the right side of the product of the textile substrate 1A.

What is claimed is:

1. A textile substrate comprising warp and weft, which wicks water and water vapor and comprises wool and at least regenerated cellulose fibers, wherein the warp comprises a plurality of warp threads and the weft comprises a plurality of weft threads, wherein each warp thread crosses over a plurality of weft threads respectively at least at one intersection and each weft thread crosses over a plurality of warp threads respectively at least at one intersection, so that the warp and the weft together form a layer which has a first surface on one side and has a second surface opposite the first surface on another side, wherein at least one of the weft threads consists of a first yarn and at least one of the weft threads consists of a second yarn, characterized in that the first yarn is a three-component yarn which comprises a plurality of first fibers made of wool, a plurality of second fibers made of regenerated cellulose and a plurality of third fibers in the form of continuous fibers made of a synthetic material, and the second yarn contains a predetermined amount of regenerated cellulose fibers, wherein the percentage of the mass of the regenerated cellulose fibers respectively contained in the second yarn as a proportion of the respective total mass of the second yarn is greater than the percentage of the mass of the respective second regenerated cellulose fibers contained in the first yarn as a proportion of the respective total mass of the first yarn, wherein the layer comprises at least one region in which the at least one weft thread consisting of the first yarn and the at least one weft thread consisting of the second yarn extend in such a way that (i) the at least one weft thread consisting of the first yarn comprises one or more longitudinal sections, which each extend between two neighboring intersections and on the first surface of the layer, and one or more longitudinal sections which each extend between two neighboring intersections and over at least a part of their length on the second surface of the layer, and (ii) the at least one weft thread consisting of the second yarn comprises one or more longitudinal sections, which each extend between two neighboring intersections and over at least a part of their length on the first surface of the layer, and one or more longitudinal sections which each extend between two neighboring intersections and on the second surface of the layer, and (iii) in the case of the at least one weft thread consisting of the first yarn the overall length of all those longitudinal sections which extend in the at least one region of the layer on the first surface of the layer is greater than the overall length of all those longitudinal sections which extend in the at least one region of the layer on the second surface of the layer, and (iv) in the case of the at least one weft thread consisting of the second yarn the overall length of all those longitudinal sections which extend in the at least one region of the layer on the first surface of the layer is smaller than the overall length of all those longitudinal sections which extend in the at least one region of the layer on the second surface of the layer.

2. A textile substrate comprising warp and weft, which wicks water and water vapor and comprises wool and at least regenerated cellulose fibers, wherein the warp comprises a plurality of warp threads and the weft comprises a plurality of weft threads, wherein each warp thread crosses over a plurality of weft threads respectively at least at one intersection and each weft thread crosses over a plurality of warp threads respectively at least at one intersection, so that the warp and the weft together form a layer which has a first surface on one side and has a second surface opposite the first surface on another side, wherein at least one of the warp threads consists of a first yarn and at least one of the warp threads consists of a second yarn, characterized in that the first yarn is a three-component yarn which comprises a plurality of first fibers made of wool, a plurality of second fibers made of regenerated cellulose and a plurality of third fibers in the form of continuous fibers made of a synthetic material, and the second yarn contains a predetermined amount of regenerated cellulose fibers, wherein the percentage of the mass of the regenerated cellulose fibers respectively contained in the second yarn as a proportion of the respective total mass of the second yarn is greater than the percentage of the mass of the respective second regenerated cellulose fibers contained in the first yarn as a proportion of the respective total mass of the first yarn, wherein the layer comprises at least one region in which the at least one warp thread consisting of the first yarn and the at least one warp thread consisting of the second yarn extend in such a way that (a) the at least one warp thread consisting of the first yarn comprises one or more longitudinal sections, which each extend between two neighboring intersections and on the first surface (2-1) of the layer, and one or more longitudinal sections which each extend between two neighboring intersections and over at least a part of their length on the second surface of the layer, and (b) the at least one warp thread consisting of the second yarn comprises one or more longitudinal sections, which each extend between two neighboring intersections least over a part of their length on the first surface of the layer, and one or more longitudinal sections which each extend between two neighboring intersections and on the second surface of the layer, and (c) in the case of the at least one warp thread consisting of the first yarn the overall length of all those longitudinal sections which extend in the at least one region of the layer on the first surface of the layer is greater than the overall length of all those longitudinal sections which extend in the at least one region of the layer on the second surface of the layer, and (d) in the case of the at least one warp thread consisting of the second yarn the overall length of all those longitudinal sections which extend in the at least one region of the layer on the first surface of the layer is smaller than the overall length of all those longitudinal sections which extend in the at least one region of the layer on the second surface of the layer.

3. The textile substrate as claimed in claim 1, wherein the weft thread consisting of the first yarn is a single yarn or a ply formed from one or more single yarns and/or the weft thread consisting of the second yarn is a single yarn or a ply formed from one or more single yarns.

4. The textile substrate as claimed in one of claim 1 or 3, wherein one or more warp threads consist of the first yarn.

5. The textile substrate as claimed in claim 4, wherein one or more weft threads consist of the second yarn and the respective weft threads cross over the respective warp threads in such a way that (i) a warp thread consisting of the first yarn forms one or more weave points in each case with weft threads consisting of the second yarn or (ii) a weft thread consisting of the second yarn forms one or more weave points in each case with warp threads consisting of the first yarn.

6. The textile substrate as claimed in claim 2, wherein the warp thread consisting of the first yarn is a single yarn or a ply formed from one or more single yarns and/or the warp thread consisting of the second yarn is a single yarn or a ply formed from one or more single yarns.

7. The textile substrate as claimed in one of claim 2 or 6, wherein one or more weft threads consist of the first yarn.

8. The textile substrate as claimed in claim 7, wherein one or more warp threads consist of the second yarn and the respective warp threads cross over the respective weft threads in such a way that (i) a weft thread consisting of the first yarn forms one or more weave points in each case with warp threads consisting of the second yarn or (ii) a warp thread consisting of the second yarn forms one or more weave points in each case with weft threads consisting of the first yarn.

9. The textile substrate as claimed in claim 1, wherein the first yarn has a longitudinal axis and a core zone surrounding the central longitudinal axis and extending along the central longitudinal axis and an outer zone surrounding the core zone and extending along the central longitudinal axis and the first fibers, the second fibers and the third fibers are spatially distributed in the first yarn in such a way that a concentration of the second fibers in the core zone is greater than in the outer zone and a concentration of the first fibers in the outer zone is greater than in the core zone and a concentration of the third fibers in the outer zone is greater than in the core zone.

10. The textile substrate as claimed in claim 1, wherein the second fiber in the first yarn is formed as a staple fiber.

11. The textile substrate as claimed in claim 1, wherein the third fiber of the first yarn comprises a polymer or a mixture of different polymers.

12. The textile substrate as claimed in claim 1, wherein the third fiber comprises one or more of the polymers polyamide, polyester or polyolefin.

13. The textile substrate as claimed in claim 1, wherein the proportion by weight of the first fibers and the second fibers relative to the total weight of the first yarn is greater than the proportion by weight of the third fibers relative to the total weight of the first yarn.

14. The textile substrate according to claim 1, wherein the first yarn comprises the first fibers in a proportion of 25-55% by weight, the second fibers in a proportion of 25-55% by weight and the third fibers in a proportion of 5-40% by weight.

15. The textile substrate as claimed in claim 1, wherein the second yarn comprises 50-100% by weight of regenerated cellulose fibers.

16. The textile substrate as claimed in claim 1, wherein each individual one of the second fibers of the first yarn and/or each individual one of the regenerated cellulose fibers of the second yarn consists of one of the materials viscose (CV), modal (CMD) or lyocell (CLY).

17. The textile substrate as claimed in claim 1, wherein the first fiber and/or the second fiber and/or the third fiber and/or the regenerated cellulose of the second yarn and/or the first yarn as a whole and/or the second yarn as a whole and/or the textile substrate as a whole is impregnated with a flame-retardant agent.

18. The textile substrate as claimed in claim 1, which with regard to penetration of water vapor through the textile substrate has a resistance to water vapor permeability with a $R_{et}$ value less than 9 $m^2$ Pa/W.

19. The textile substrate as claimed in claim 1, which has a thermal resistance which is less than 24 $10^{-3}$ $m^2K/W$.

20. The textile substrate as claimed in claim 1 which is dyed and has a reflectivity for infrared radiation in the wavelength range from 800 nm to 2000 nm on average of at least 50%.

21. A covering material for covering a seat and/or a seat back and/or a side part and/or an armrest of a seat unit, consisting of a textile substrate as claimed in claim 1, wherein the first surface forms the right side of the product.

22. A seat unit with at least part of the seat unit including the textile substrate of claim 1, the textile substrate including a first surface, the seat unit comprising:

at least one of a seat, a seat back, a side part, or an armrest, wherein the at least one of the seat, seat back, side part, or the armrest includes an outer surface including the first surface of the textile substrate.

23. The textile substrate as claimed in claim 2, wherein the first yarn has a longitudinal axis and a core zone surrounding the central longitudinal axis and extending along the central longitudinal axis and an outer zone surrounding the core zone and extending along the central longitudinal axis and the first fibers, the second fibers and the third fibers are spatially distributed in the first yarn in such a way that a concentration of the second fibers in the core zone is greater than in the outer zone and a concentration of the first fibers in the outer zone is greater than in the core zone and a concentration of the third fibers in the outer zone is greater than in the core zone.

24. The textile substrate as claimed in claim 2, wherein the second fiber in the first yarn is formed as a staple fiber.

25. The textile substrate as claimed in claim 2, wherein the third fiber of the first yarn comprises a polymer or a mixture of different polymers.

26. The textile substrate as claimed in claim 2, wherein the third fiber comprises one or more of the polymers polyamide, polyester or polyolefin.

27. The textile substrate as claimed in claim 2, wherein the proportion by weight of the first fibers and the second fibers relative to the total weight of the first yarn is greater than the proportion by weight of the third fibers relative to the total weight of the first yarn.

28. The textile substrate according to claim 2, wherein the first yarn comprises the first fibers in a proportion of 25-55% by weight, the second fibers in a proportion of 25-55% by weight and the third fibers in a proportion of 5-40% by weight.

29. The textile substrate as claimed in claim 2, wherein the second yarn comprises 50-100% by weight of regenerated cellulose fibers.

30. The textile substrate as claimed in claim 2, wherein each individual one of the second fibers of the first yarn and/or each individual one of the regenerated cellulose fibers of the second yarn consists of one of the materials viscose (CV), modal (CMD) or lyocell (CLY).

31. The textile substrate as claimed in claim 2, wherein the first fiber and/or the second fiber and/or the third fiber and/or the regenerated cellulose of the second yarn and/or the first yarn as a whole and/or the second yarn as a whole and/or the textile substrate as a whole is impregnated with a flame-retardant agent.

32. The textile substrate as claimed in claim 2, which with regard to penetration of water vapor through the textile substrate has a resistance to water vapor permeability with a $R_{et}$ value less than 9 $m^2$ Pa/W.

33. The textile substrate as claimed in claim 2, which has a thermal resistance which is less than 24 $10^{-3}$ $m^2K/W$.

34. The textile substrate as claimed in claim 2 which is dyed and has a reflectivity for infrared radiation in the wavelength range from 800 nm to 2000 nm on average of at least 50%.

35. A covering material for covering a seat and/or a seat back and/or a side part and/or an armrest of a seat unit, consisting of a textile substrate as claimed in claim 2, wherein the first surface forms the right side of the product.

36. A seat unit with at least part of the seat unit including the textile substrate of claim 2, the textile substrate including a first surface, the seat unit comprising:

at least one of a seat, a seat back, a side part, or an armrest, wherein the at least one of the seat, seat back, side part, or the armrest includes an outer surface including the first surface of the textile substrate.

* * * * *